US010954973B2

(12) United States Patent
Shahroudi et al.

(10) Patent No.: US 10,954,973 B2
(45) Date of Patent: Mar. 23, 2021

(54) UNSUPPORTED PISTON WITH MOVING SEAL CARRIER

(71) Applicant: Woodward, Inc., Fort Collins, CO (US)

(72) Inventors: Kamran Eftekhari Shahroudi, Fort Collins, CO (US); Barry Brinks, Fort Collins, CO (US)

(73) Assignee: Woodward, Inc., Fort Collins, CO (US)

( * ) Notice: Subject to any disclaimer, the term of this patent is extended or adjusted under 35 U.S.C. 154(b) by 161 days.

(21) Appl. No.: 16/033,902

(22) Filed: Jul. 12, 2018

(65) Prior Publication Data

US 2019/0017523 A1 Jan. 17, 2019

Related U.S. Application Data

(60) Provisional application No. 62/532,785, filed on Jul. 14, 2017.

(51) Int. Cl.
*F15B 15/12* (2006.01)
*F01C 9/00* (2006.01)

(52) U.S. Cl.
CPC ..... *F15B 15/125* (2013.01); *F01C 9/00* (2013.01)

(58) Field of Classification Search
CPC ..... F01C 9/002; F01C 21/08; F15B 15/02; F15B 15/06; F15B 15/125
See application file for complete search history.

(56) References Cited

U.S. PATENT DOCUMENTS

| | | | |
|---|---|---|---|
| 1,032,694 | A | 7/1912 | Milne |
| 1,704,716 | A | 3/1929 | Bailey |
| 2,630,786 | A | 3/1953 | Poore |
| 2,801,068 | A | 7/1957 | Paul |
| 2,896,413 | A | 7/1959 | Hussey |

(Continued)

FOREIGN PATENT DOCUMENTS

| | | |
|---|---|---|
| CH | 122141 | 9/1927 |
| CN | 101893016 | 11/2010 |

(Continued)

OTHER PUBLICATIONS

International Preliminary Report on Patentability in International Application No. PCT/US2018/041788, dated Jan. 23, 2020, 20 pages.

(Continued)

*Primary Examiner* — Dustin T Nguyen
(74) *Attorney, Agent, or Firm* — Fish & Richardson P.C.

(57) ABSTRACT

The subject matter of this specification can be embodied in, among other things, a rotary actuator that includes a housing defining a first arcuate chamber portion and comprising a first cavity, a first open end, a first seal carrier assembly defining a second arcuate chamber portion and comprising a second cavity in fluid communication with the first cavity, a first piston seal, a second open end, and a third open end opposite the second open end, a first face seal in sealing contact with the housing proximal to the first open end and the second open end, a rotary output assembly, and an arcuate-shaped first piston disposed in said housing for reciprocal movement in the first arcuate chamber portion and in the second arcuate chamber portion.

21 Claims, 11 Drawing Sheets

(56) References Cited

U.S. PATENT DOCUMENTS

| | | | | | |
|---|---|---|---|---|---|
| 2,974,645 | A | | 3/1961 | Sune | |
| 2,996,049 | A | * | 8/1961 | Huska | F16K 31/12 92/120 |
| 3,059,683 | A | | 10/1962 | Atherton | |
| 3,279,755 | A | | 10/1966 | Notenboom | |
| 3,351,121 | A | | 11/1967 | Rumsey | |
| 3,367,424 | A | | 2/1968 | Shunichi et al. | |
| 3,444,788 | A | | 5/1969 | Sneen | |
| 3,446,120 | A | | 5/1969 | Sneen | |
| 3,731,546 | A | | 5/1973 | Macdonald | |
| 3,731,597 | A | * | 5/1973 | Payne | F15B 15/125 92/120 |
| 3,877,349 | A | | 4/1975 | Schindel | |
| 3,995,536 | A | * | 12/1976 | Tenfjord | F03C 4/00 92/120 |
| 4,033,519 | A | | 7/1977 | Abe et al. | |
| 4,242,947 | A | | 1/1981 | Renner et al. | |
| 4,459,898 | A | | 7/1984 | Harjar et al. | |
| 4,590,816 | A | | 5/1986 | Weyer | |
| 4,755,104 | A | | 7/1988 | Castro et al. | |
| 4,850,329 | A | | 7/1989 | Taylor et al. | |
| 4,945,778 | A | | 8/1990 | Weyer | |
| 5,007,330 | A | * | 4/1991 | Scobie | F15B 15/125 277/589 |
| 5,054,374 | A | * | 10/1991 | Scobie | F15B 15/125 277/581 |
| 5,109,754 | A | | 5/1992 | Shaw | |
| 5,113,107 | A | | 5/1992 | Atsumi et al. | |
| 5,235,900 | A | * | 8/1993 | Garceau | F15B 15/125 92/120 |
| 5,495,791 | A | * | 3/1996 | Sande | F01C 9/002 92/120 |
| 5,549,448 | A | | 8/1996 | Langston | |
| 5,996,523 | A | | 12/1999 | Fox | |
| 6,276,660 | B1 | | 8/2001 | Wittkopp | |
| 6,361,033 | B1 | | 3/2002 | Jones et al. | |
| 6,769,868 | B2 | | 8/2004 | Harrold | |
| 6,843,605 | B2 | | 1/2005 | Tamada et al. | |
| 7,685,929 | B2 | | 3/2010 | Mainville | |
| 7,895,935 | B2 | * | 3/2011 | Kells | F15B 15/125 92/120 |
| 8,435,000 | B2 | | 5/2013 | Wong et al. | |
| 8,801,290 | B2 | | 8/2014 | Heshmat | |
| 9,133,923 | B2 | | 9/2015 | Ito et al. | |
| 9,163,648 | B2 | * | 10/2015 | Kim | F15B 15/125 |
| 10,352,169 | B2 | * | 7/2019 | Ito | F01C 9/002 |
| 2009/0058581 | A1 | | 3/2009 | Neff et al. | |
| 2012/0043832 | A1 | | 2/2012 | Neff et al. | |
| 2013/0133513 | A1 | | 5/2013 | Ito et al. | |
| 2014/0087915 | A1 | | 3/2014 | Rohs et al. | |
| 2014/0238227 | A1 | | 8/2014 | Kim et al. | |
| 2015/0322790 | A1 | | 11/2015 | Yao et al. | |
| 2016/0010666 | A1 | | 1/2016 | Kim et al. | |
| 2016/0177722 | A1 | | 6/2016 | Ito et al. | |
| 2018/0094652 | A1 | * | 4/2018 | Rose | B25J 15/0009 |
| 2018/0172033 | A1 | | 6/2018 | Shahroudi et al. | |
| 2019/0113056 | A1 | * | 4/2019 | Kells | F15B 15/082 |

FOREIGN PATENT DOCUMENTS

| | | |
|---|---|---|
| DE | 1176491 | 8/1964 |
| DE | 2600459 | 7/1977 |
| DE | 3016427 | 4/1983 |
| DE | 3245677 | 6/1984 |
| DE | 10322501 | 12/2004 |
| EP | 0229833 | 7/1987 |
| EP | 1101902 | 5/2001 |
| EP | 2022919 | 2/2009 |
| EP | 2586966 | 5/2013 |
| EP | 2644823 | 10/2013 |
| EP | 3037677 | 6/2016 |
| GB | 1199847 | 7/1970 |
| GB | 1261801 | 1/1972 |
| JP | S5530523 | 3/1980 |
| JP | S58604 | 1/1983 |
| JP | S59122402 | 8/1984 |
| JP | H11193772 | 7/1999 |
| WO | WO 1993025818 | 12/1993 |
| WO | WO 03008781 | 1/2003 |
| WO | WO 2007003000 | 1/2007 |
| WO | WO 2014133884 | 9/2014 |
| WO | WO 2014133939 | 9/2014 |
| WO | WO2015007943 | 1/2015 |
| WO | WO 2017171564 | 10/2017 |

OTHER PUBLICATIONS

"Becker" Rotary Piston Spring Return Rpsr Actuators, GE Oil & Gas, Sep. 2014, 16 pages. http://exionasia.com/wp-content/uploads/2015/01/GEA19652_Becker-RPSR-Actuator-Brochure.pdf.

International Search Report and Written Opinion in International Application No. PCT/US2018/041788, dated Oct. 24, 2018, 28 pages.

International Search Report and Written Opinion of the International Searching Authority issued in International Application No. PCT/US2017/045628 dated May 7, 2018, 24 pages.

International Search Report and Written Opinion of the International Searching Authority issued in International Application No. PCT/US2017/045631 dated May 7, 2018, 20 pages.

Invitation to Pay Additional Fees and partial International Search Report issued in International Application No. PCT/US2017/045628 dated Nov. 7, 2017; 15 pages.

Invitation to Pay Additional Fees and partial International Search Report issued in International Application No. PCT/US2017/045631 dated Nov. 7, 2017; 14 pages.

O'Neill, "Scotch Yoke Piston Actuators," Automated & Manual Valves and Flow Meters, Assured Automation, Nov. 27, 2012, 4 pages.

PCT International Search Report and Written Opinion of the International Searching Authority, PCT/US2017/055153, dated Jan. 19, 2018, 10 pages.

Sparow, "Hydraulic Oscillating Actuator," May 7, 2010, 2 pages. http://www.hydraulicstatic.com/20100507_hydraulic-oscillating-actuator.html.

Chinese Office Action in CN Appln. No. 201780062254, dated Oct. 10, 2020, 5 pages.

* cited by examiner

SECTION A–A

UNSUPPORTED PISTON WITH MOVING SEAL CARRIER

CROSS-REFERENCE TO RELATED APPLICATION(S)

This application claims the benefit of priority to U.S. Provisional Application Ser. No. 62/532,785, filed on Jul. 14, 2017, the contents of which are hereby incorporated by reference.

TECHNICAL FIELD

This invention relates to an actuator device and more particularly to a constant torque rotary piston type actuator device wherein the pistons of the rotor are moved by fluid under pressure.

BACKGROUND

Linear hydraulic actuators of various forms are currently used in industrial mechanical power conversion applications. One common industrial usage is in construction equipment (e.g., excavators, backhoes) in which the linear action of a hydraulic piston is converted to rotary motion about a joint.

In certain applications, such as the actuators used for heavy equipment operation, increased actuation speed, wide ranges of motion, efficiency of fluid power usage, and ease of maintenance are desired. However, despite their widespread use, it can be difficult to provide such characteristics in typical heavy equipment applications of linear hydraulic actuators, e.g., on the arm and bucket of an excavator.

Rotary hydraulic actuators of various forms are also currently used in other types of industrial mechanical power conversion applications. This industrial usage is commonly for applications where continuous inertial loading is desired without the need for load holding for long durations, e.g., aircraft using rotary vane actuators on flight control surfaces, and applications where load holding is not an issue, e.g., backhoes using hydraulic motors to pivot the house or boom horizontally relative to the undercarriage. The designs of such actuators, however, do not scale well to provide the combinations of power-to-weight ratios, field-serviceability features, stiffnesses, holding capacities, torque-to-weight ratios, slew rates, energy efficiency, and/or the field-serviceability typically expected by heavy equipment operators for use elsewhere in their equipment, e.g., actuation of the bucket, stick and boom of an excavator.

SUMMARY

In general, this document describes rotary piston type actuator devices.

In a first aspect, a rotary actuator includes a housing defining a first arcuate chamber portion and having a first cavity, a first open end, and a first fluid port in fluid communication with the first cavity, a first seal carrier assembly defining a second arcuate chamber portion and having a second cavity in fluid communication with the first cavity, a first piston seal, a second open end, and a third open end opposite the second open end, a first face seal in sealing contact with the first housing proximal to the first open end and the second open end, a rotary output assembly, and an arcuate-shaped first piston disposed in said housing for reciprocal movement in the first arcuate chamber portion and in the second arcuate chamber portion through the first open end, the second open end, and the third open end, wherein the first piston seal, the first face seal, the first cavity, the second cavity, and the first piston define a first pressure chamber, and a first portion of the first piston contacts the rotary output assembly.

Various embodiments can include some, all, or none of the following features. The first seal carrier assembly can be configured for movement relative to the housing. The housing can further define a third arcuate chamber portion and having a third cavity, a fourth open end, and a second fluid port in fluid communication with the third cavity, and the rotary actuator can also include a second seal carrier assembly defining a fourth arcuate chamber portion and having a fourth cavity in fluid communication with the third cavity, a second piston seal, a fifth open end, and a sixth open end opposite the fifth open end, a second face seal in sealing contact with the housing proximal the fourth open end and the fifth open end, and an arcuate-shaped second piston disposed in said housing for reciprocal movement in the third arcuate chamber portion and in the fourth arcuate chamber portion through the fourth open end, the fifth open end, and the sixth open end, wherein the second piston seal, the second face seal, the third cavity, the fourth cavity, and the second piston define a second pressure chamber, and a first portion of the second piston contacts the rotary output assembly. The second piston can be oriented in the same rotational direction as the first piston. The second piston can be oriented in the opposite rotational direction as the first piston. The rotary actuator can also include an outer housing disposed about the housing and having a second fluid port, wherein the outer housing, the housing, the first piston seal, and the first piston define a second pressure chamber. The first piston seal can be disposed about an interior surface of the third open end. The housing can be formed as a one-piece housing. The first piston can be at least partly hollow in cross-section. A structural member inside the first piston can be located between two cavities inside the first piston. The first piston can have one of a square, rectangular, ovoid, elliptical, or circular shape in cross-section. The first piston can be removably affixed to and extends from a first rotor arm at a predetermined angle to the first rotor arm.

In a second aspect, a method of rotary actuation includes providing a rotary actuator having a housing defining a first arcuate chamber portion and including a first cavity, a first open end, and a first fluid port in fluid communication with the first cavity, a first seal carrier assembly defining a second arcuate chamber portion and having a second cavity in fluid communication with the first cavity, a first piston seal, a second open end, and a third open end opposite the second open end, a first face seal in sealing contact with the housing proximal to the first open end and the second open end, a rotary output assembly, and an arcuate-shaped first piston disposed in said housing for reciprocal movement in the first arcuate chamber portion and in the second arcuate chamber portion through the first open end, the second open end, and the third open end, wherein the first piston seal, the first face seal, the first cavity, the second cavity, and the first piston define a first pressure chamber, and a first portion of the first piston contacts the rotary output assembly, applying pressurized fluid to the first pressure chamber, urging the first piston partially outward from the first pressure chamber to urge rotation of the rotary output assembly in a first direction, rotating the rotary output assembly in a second direction opposite that of the first direction, and, urging the first piston partially into the first pressure chamber to urge pressurized fluid out the first fluid port.

Various implementations can includes some, all, or none of the following features. The method can also include urging, by the first piston, movement of the first seal carrier assembly relative to the housing. The housing can also define a third arcuate chamber portion and having a third cavity, a fourth open end, and a second fluid port in fluid communication with the third cavity, and the rotary actuator can also include a second seal carrier assembly defining a fourth arcuate chamber portion and having a fourth cavity in fluid communication with the third cavity, a second piston seal, a fifth open end, and a sixth open end opposite the fifth open end, a second face seal in sealing contact with the housing proximal the fourth open end and the fifth open end, and an arcuate-shaped second piston disposed in said housing for reciprocal movement in the third arcuate chamber portion and in the fourth arcuate chamber portion through the fourth open end, the fifth open end, and the sixth open end, wherein the second piston seal, the second face seal, the third cavity, the fourth cavity, and the second piston define a second pressure chamber, and a first portion of the second piston contacts the rotary output assembly. The second piston can be oriented in the opposite rotational direction as the first piston. The rotary actuator can also include an outer housing disposed about the housing and having a second fluid port, wherein the outer housing, the housing, the first piston seal, and the first piston define a second pressure chamber. Rotating the rotary output assembly in a second direction opposite that of the first direction can include applying pressurized fluid to the second pressure chamber, and urging the second piston partially outward from the second pressure chamber to urge rotation of the rotary output assembly in a second direction opposite from the first direction. Rotating the rotary output assembly in a second direction opposite that of the first direction can include applying pressurized fluid to the second pressure chamber, and urging the first piston partially into the first pressure chamber to urge rotation of the rotary output assembly in a second direction opposite from the first direction. Urging the first piston partially outward from the first pressure chamber to urge rotation of the rotary output assembly in a first direction can include rotating the output assembly in the first direction with substantially constant torque over stroke. The first seal can be disposed about an interior surface of the third open end. The first piston can be removably affixed to and extends from the rotary output assembly at a predetermined angle to the rotary output assembly.

In a third aspect, a rotary actuator includes a housing defining a first arcuate chamber and having a cavity, a fluid port in fluid communication with the cavity, and an open end, a rotary output assembly, an arcuate-shaped piston extending from a first piston portion affixed to the rotary output assembly to a second piston portion spaced apart from rotary output assembly, disposed in said housing for reciprocal movement in the arcuate chamber through the open end, wherein a seal, the cavity, and the piston define a pressure chamber, wherein a first radially outward surface portion of the first piston portion is configured for reciprocal motion along a first arc having a first radius from an axis, and a second radially outward surface portion of the second piston portion is capable of reciprocal and radial motion along a second arc having a variable second radius from the axis, and a load bearing assembly having a radially inward surface facing the piston, spaced radially apart from the piston, configured for reciprocal movement along a third arc that is coaxial to the first arc, and has a third radius from the axis that is radially larger than the first radius and is radially smaller than a portion of the variable second radius.

Various embodiments can include some, all, or none of the following features. The load bearing assembly can be affixed to the housing. The piston can be arranged to contact the load bearing assembly when the second radius exceeds the third radius. The rotary actuator can also include a spring member arranged to provide a bias force against the load bearing assembly and urging reciprocal movement of the load bearing assembly toward the open end. Application of pressurized fluid to the pressure chamber can urge the piston partially outward from the pressure chamber to urge rotation of the rotary output assembly in a first direction, and rotation of the rotary output assembly in a second direction opposite that of the first direction urges the piston partially into the pressure chamber to urge pressurized fluid out the fluid port. The piston can be solid in cross-section. The piston can be at least partly hollow in cross-section. A structural member inside the piston can be located between two cavities inside the piston. The piston can have one of a square, rectangular, ovoid, elliptical, or circular shape in cross-section. The rotary actuator can also include a rotor shaft and the load bearing assembly also includes a hinge at a proximal end configured for reciprocal movement upon the rotor shaft, wherein the rotary output assembly rotates concentrically about the rotor shaft and defines a radial aperture having a first radial face, and the load bearing assembly can also include a body extending from the hinge through the radial aperture to a distal end having the radially inward surface, the body having a second radial face configured to contact the first radial face.

In a fourth aspect, a method of rotary actuation includes providing a rotary actuator having a housing defining a first arcuate chamber and having a cavity, a fluid port in fluid communication with the cavity, and an open end, a rotary output assembly, an arcuate-shaped piston extending from a first piston portion affixed to the rotary output assembly to a second piston portion spaced apart from rotary output assembly, disposed in said housing for reciprocal movement in the arcuate chamber through the open end, wherein a seal, the cavity, and the piston define a pressure chamber, and a load bearing assembly having a radially inward surface facing, and spaced radially apart from, the piston, applying pressurized fluid to the pressure chamber, urging the piston partially outward from the pressure chamber, urging, by the piston, rotation of the rotary output assembly in a first direction, moving the load bearing assembly into alignment with a predetermined load bearing position relative to the piston, contacting the piston to the radially inward surface, and constraining, by the load bearing assembly and based on the contacting, radially outward motion of the second radially outward surface portion.

Various implementations can include some, all, or none of the following features. The method can also include urging, by the rotary output assembly, movement of the load bearing assembly at substantially the same speed and direction as the piston. The rotary actuator can also include a rotor shaft and the load bearing assembly can also include a hinge at a proximal end configured for reciprocal movement upon the rotor shaft, wherein the rotary output assembly rotates concentrically about the rotor shaft and defines a radial aperture having a first radial face, and the load bearing assembly can also have a body extending from the hinge through the radial aperture to a distal end having the radially inward surface, the body having a second radial face configured to contact the first radial face, wherein urging movement of the load bearing assembly at substantially the same speed and direction as the piston can also include contacting the first radial face to the second radial face. The method can also include urging radial movement of a portion of the piston in a radially outward direction, wherein contact between the piston and the radially inward surface is based on the radial movement in the radially outward direction. The method can also include urging rotation of the rotary output assembly in a second direction opposite the first direction, urging, by rotation of the rotary output assembly in the second direction, the piston partially into the pressure chamber, and separating the piston from contact with the radially inward surface. The method can also include urging radial movement of a portion of the piston in a radially inward direction, wherein separation of the piston from the radially inward surface is based on the radial movement in the radially inward direction. The method can also include biasing, based on the movement of the load bearing assembly in the first direction, a spring member arranged to provide a bias force against the load bearing assembly, and urging, by the bias force, movement of the load bearing assembly in a second direction opposite the first direction. Urging, by the piston, rotation of the rotary output assembly can also include rotating the rotary output assembly with substantially constant torque over stroke.

The systems and techniques described here may provide one or more of the following advantages. First, a system can provide a rotary piston actuator having many of the advantages of linear piston actuators. Second, the system can provide actuation having substantially constant torque over its range of stroke. Third, the system can be built with significant cost and weight reductions compared to other rotary actuation designs for heavy-duty (e.g., up to 10 million Nm) applications.

The details of one or more implementations are set forth in the accompanying drawings and the description below. Other features and advantages will be apparent from the description and drawings, and from the claims.

DETAILED DESCRIPTION

Figure 1:
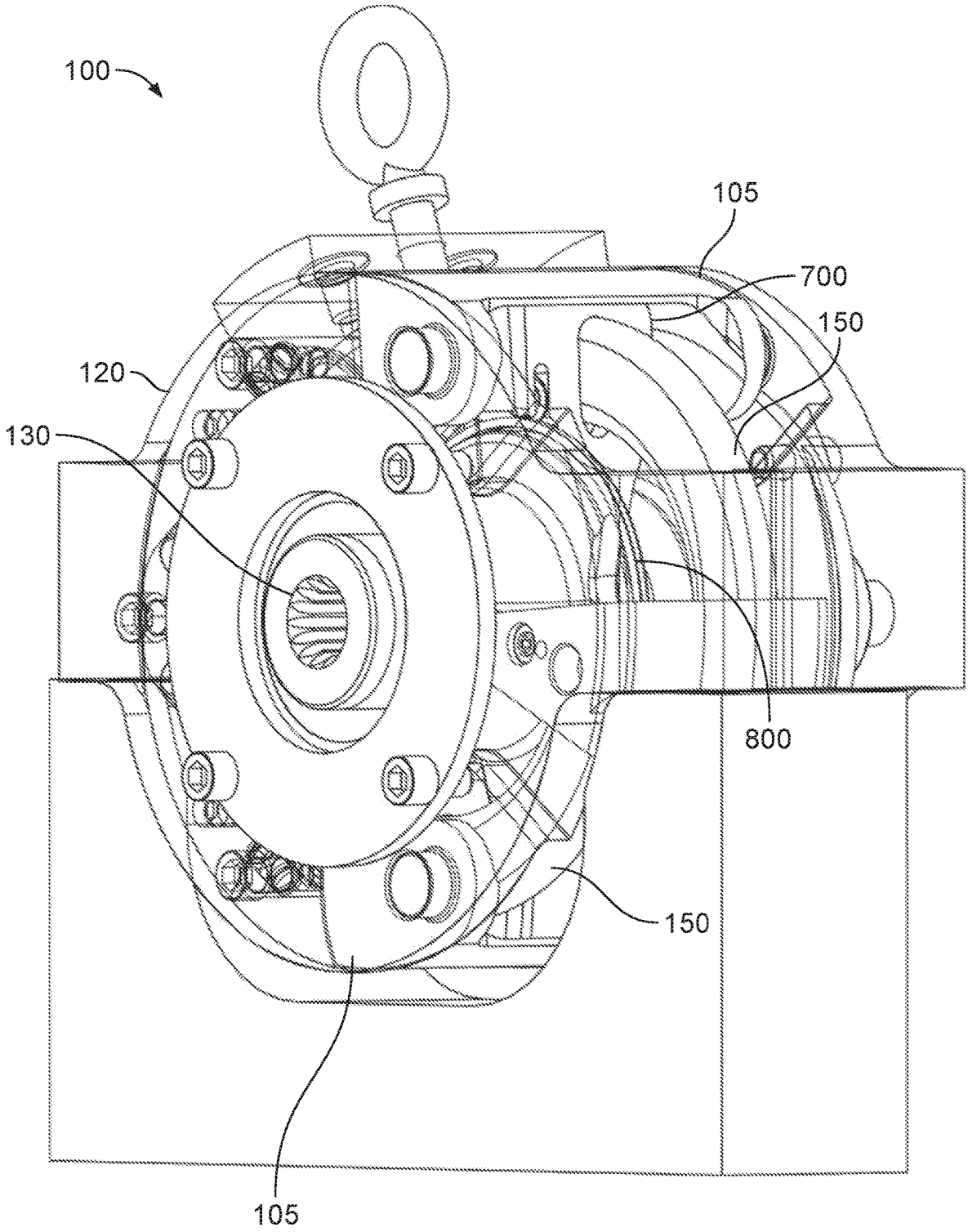
FIG. 1 is a perspective view of an example rotary piston actuator.

This document describes devices for producing rotary motion. In particular, this document describes rotary piston actuator devices that can convert fluid displacement into rotary motion through the use of components more commonly used for producing linear motion, e.g., hydraulic or pneumatic linear cylinders. In particular, the rotary piston actuators described in this document include features that can help a rotary piston actuator provide substantially constant torque over stroke over a wide range of angles, loads, and fluid pressures. Vane-type rotary actuators are relatively compact devices used to convert fluid motion into rotary motion. Rotary vane actuators (RVA), however, generally use seals and component configurations that exhibit cross-vane leakage of the driving fluid. Such leakage can affect the range of applications in which such designs can be used. Some applications may require a rotary actuator to hold a rotational load in a selected position for a predetermined length of time, substantially without rotational movement, when the actuator's fluid ports are blocked. For example, some aircraft applications may require that an actuator hold a flap or other control surface that is under load (e.g., through wind resistance, gravity or g-forces) at a selected position when the actuator's fluid ports are blocked. Cross-vane leakage, however, can allow movement from the selected position.

Linear pistons use relatively mature sealing technology that exhibits well-understood dynamic operation and leakage characteristics that are generally better than rotary vane actuator type seals. Linear pistons, however, require additional mechanical components in order to adapt their linear motions to rotary motions. Linear-to-rotary mechanisms typically exhibit a very significant reduction in torque. For example, construction equipment easily lose more than 80% to 90% torque at one or both ends of rotary motion due to the vanishing moment arm of the linear to rotary mechanism. Other than the effect of vanishing moment arm, the linear to rotary convertor itself can also be major source of frictional torque loss. A brochure for one example commercially available actuator publishes a 15% frictional torque loss that is proportional to the fluid pressure.

In addition, combinations of linear actuation plus linear-to-rotary mechanism typically require a relatively larger total volume of pumped or pressurized fluid in order to provide a full range of rotary motion. This additional flow of pressurized fluid directly translates to major loss of fluid system efficiency, and to oversizing of the fluid supply system and the engine that drives it.

The inability of the linear actuator plus linear-to-rotary converter to provide constant torque for large range of angular motion in turn can lead to inefficient, oversized, and less productive rotary motion when compared to actuators that provide pure rotary actuation from fluid pressure directly. Linear-to-rotary mechanisms may also generally be installed in an orientation that is different from that of the load they are intended to drive, and therefore may provide their torque output indirectly, e.g., installed to push or pull a lever arm that is at a generally right angle to the axis of the axis of rotation of the lever arm. Such linear-to-rotary mechanisms may therefore become too large or heavy for use in some applications, such as aircraft control where space and weight constraints may make such mechanisms impractical for use.

In general, rotary piston assemblies use curved pressure chambers and curved pistons to controllably push and pull the rotor arms of a rotor assembly about an axis. In use, certain embodiments of the rotary piston assemblies described herein can provide the positional holding characteristics generally associated with linear piston-type fluid actuators, to rotary applications, and can do so using the relatively more compact and lightweight envelopes generally associated with rotary vane actuators.

Some rotary piston assembles, however, can exhibit inconsistent torque outputs over their strokes, especially at high angles of rotation with heavy loads. In some examples, high fluid pressures may be required in order to move or support heavy loads, but as the rotary piston extends these pressures and loads not only urge rotary movement of the piston, they can also cause unwanted radial (e.g., outward) deflections or deformations of the piston. Such deformation can cause mechanical interference and/or friction between the piston and the pressure chamber, the mouth of the pressure chamber, piston seals, and other components, resulting is torque loss. The rotary piston actuators described in this document include features that reduce or eliminate the effects of radial deformation of the piston, and can provide substantially constant torque over stroke over a wide range of angles and loads.

Figure 2:
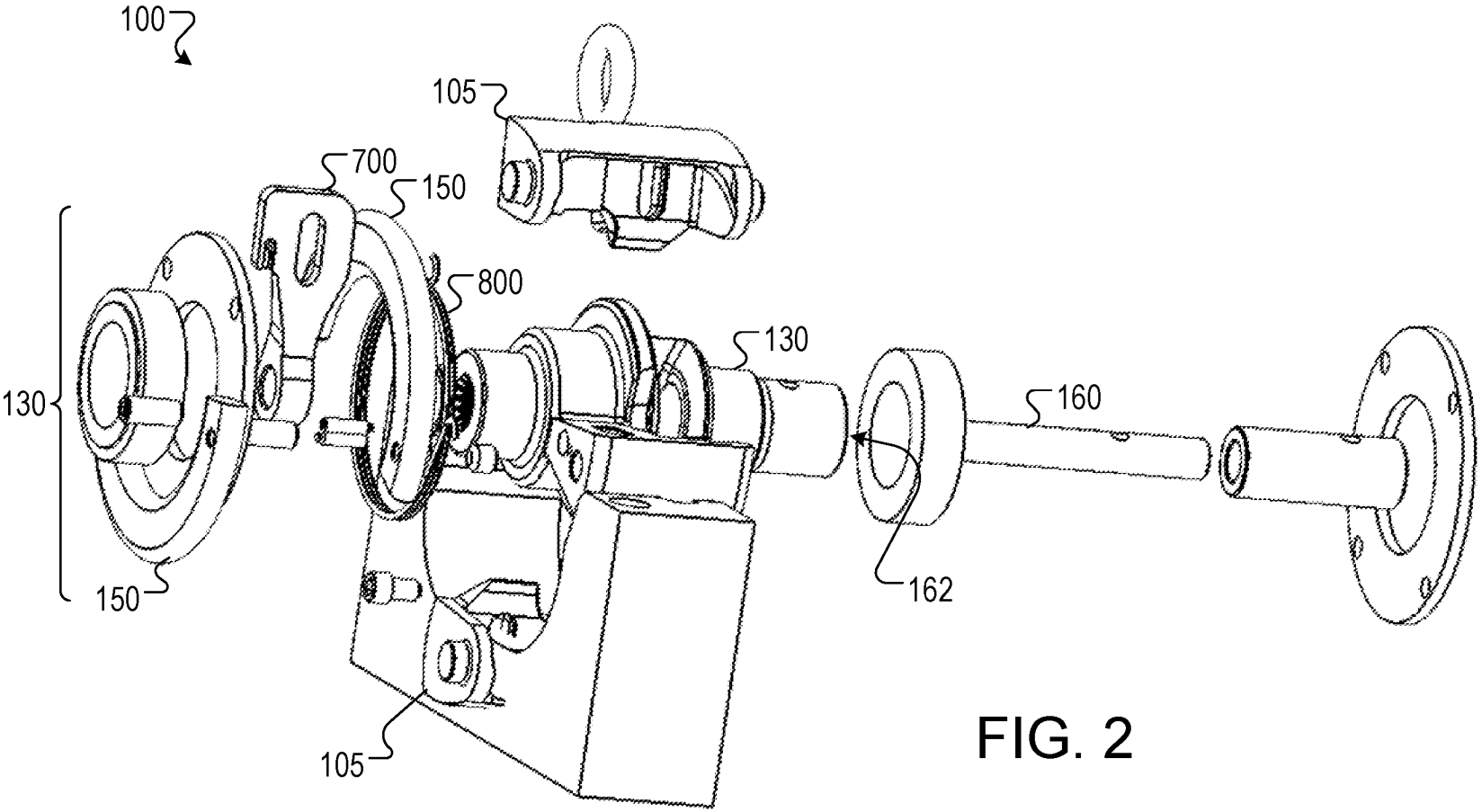
FIG. 2 is a partial exploded view of the example rotary piston actuator of FIG. 1.

FIGS. 1 and 2 show two views of an example rotary piston actuator 100. Referring to FIG. 1, a perspective view of the example rotary piston-type actuator 100 is shown. The actuator 100 includes a pressure chamber assembly 120 (e.g., a housing) and a rotary output assembly 130. Referring now to both FIG. 1 and FIG. 2, in which a partial exploded view of the example actuator 100 is shown. The rotary output assembly 130 includes a pair of rotary pistons 150. A central shaft 160 is arranged in a central bore 162 rotary output assembly 130 such that the central shaft 160 and the rotary output assembly 130 can rotate independently and coaxially relative to each other. While the example actuator 100 includes two of the rotary pistons 150, other embodiments can include greater and/or lesser numbers of cooperative and opposing rotary pistons. The rotary pistons 150 in the example assembly of FIGS. 1 and 2 are oriented substantially opposite each other in the same rotational arc. In some embodiments, the actuator 100 can rotate the rotor rotary output assembly 130 about 160 degrees total.

The rotary piston actuator 100 also includes a pair of seal carrier assemblies 105, a pair of load bearing assemblies 700 (with only one being visible in these views), and a spring member 800. The pressure chamber assembly 120 includes a pair of cavities (not shown) configured to act as pressure chambers for the rotary pistons 150. In some embodiments, the pressure chamber assembly 120 can be a housing a formed as a one-piece, unitary housing formed from a single piece of material. Seal carrier assemblies such as the seal carrier assembly 105 will be discussed further in the descriptions of FIGS. 3-6 and 10. The load bearing assembly 700, the rotary output assembly 130, and the spring member 800 will be discussed further in the descriptions of FIGS. 6-9B and 11.

Figure 3:
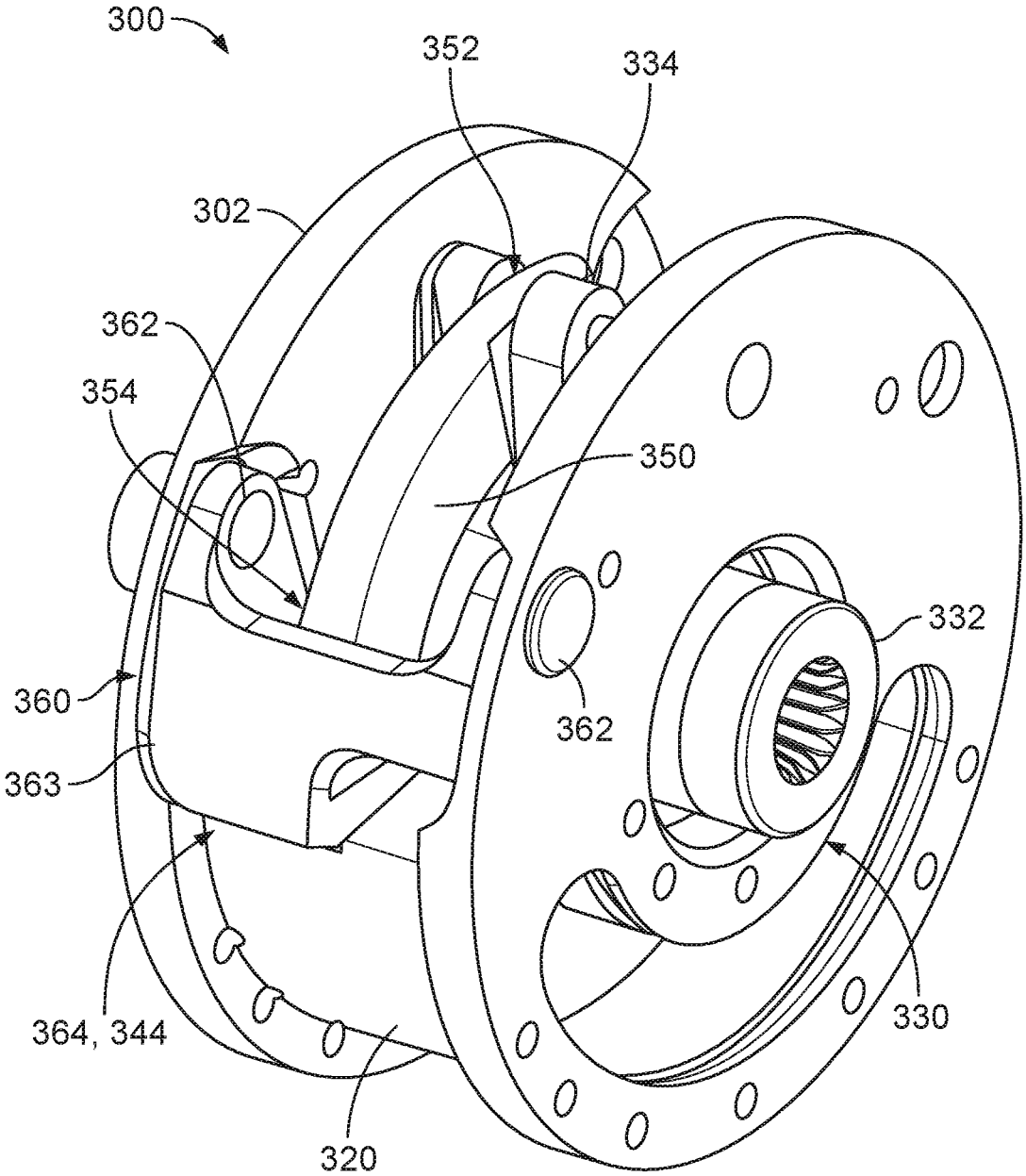
FIG. 3 is a perspective view of another example rotary piston actuator.
Figure 4:
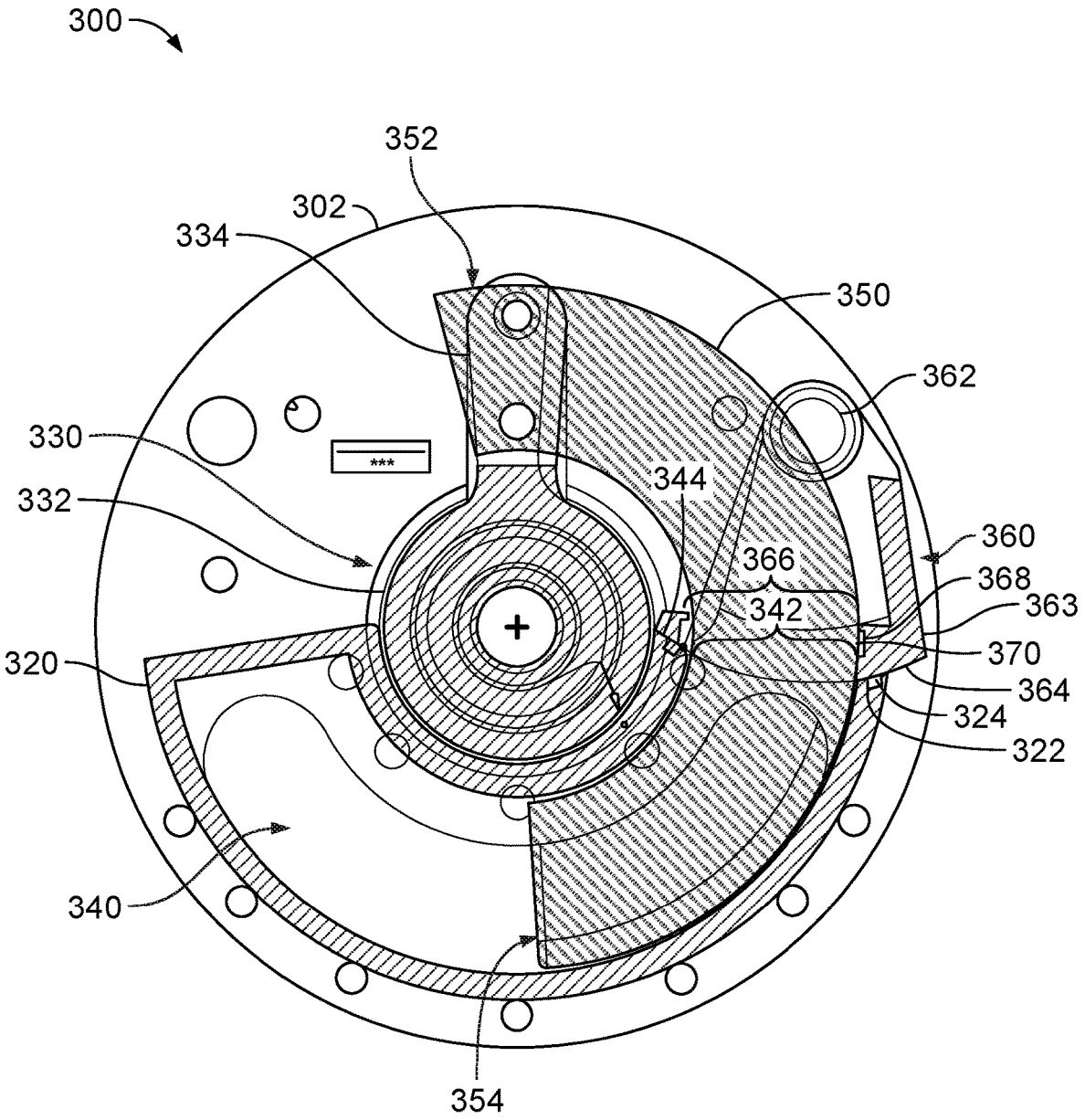
FIG. 4 is a sectional side view of the example rotary piston actuator of FIG. 3.
Figure 5A:
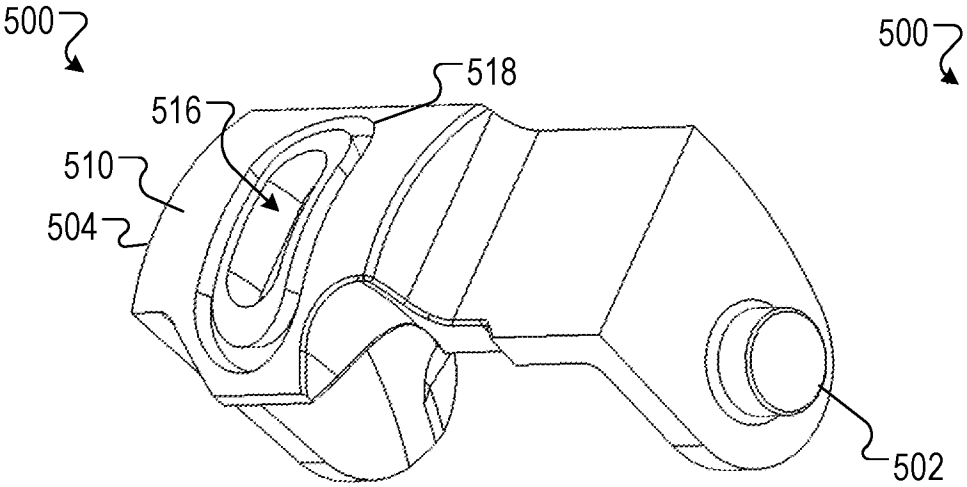
FIGS. 5A-5D are perspective, rear, top, and side views of an example seal carrier assembly.
Figure 5B:
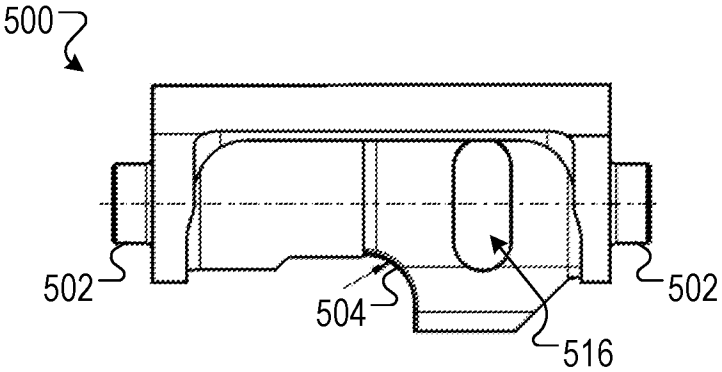
Figure 5C:
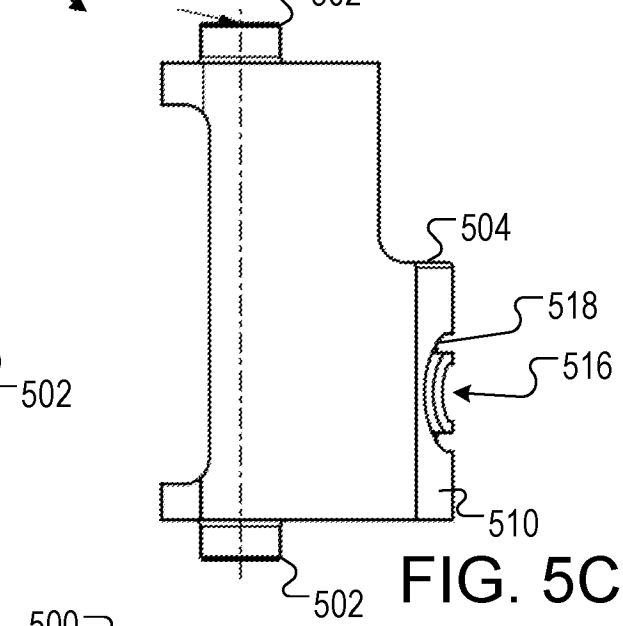
Figure 5D:
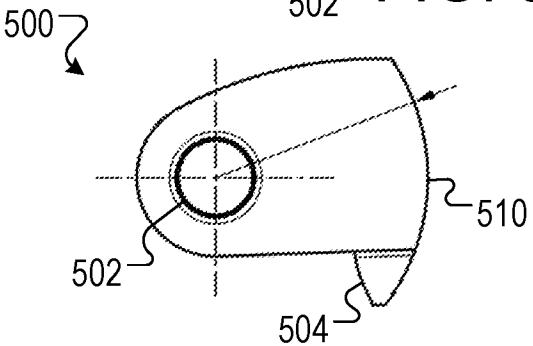

FIG. 3 is a perspective view of another example rotary piston actuator 300, and FIG. 4 is a sectional side view of the example rotary piston actuator 300. In some embodiments, the actuator 300 can be a simplified version of the example actuator 100 of FIGS. 1 and 2. The actuator 300 mainly differs from the example actuator 100, for example, in that instead of implementing a pair of rotary pistons, e.g., two of the rotary pistons 150, an individual rotary piston 350 is used. The load bearing assembly 700 is also omitted from the example actuator 300 for visual simplicity, but will be discussed further in the descriptions of FIGS. 6-9B and 11.

The example actuator 300 includes a rotary output assembly 330 and a pressure chamber assembly 320 affixed to a housing 302. The rotary output assembly 330 includes a rotor shaft 332 positioned along a central axis of the actuator 300. A rotor arm 334 extends radially from the rotor shaft 332. A rotary piston 350 is removably affixed to the rotor arm 334 at a first end 352 of the rotary piston 350. The first end 352 is affixed at a predetermined angle (e.g., perpendicular) to the rotor arm 334, and the rotary piston 350 extends away from the rotor arm 334 toward a second end 354 in a curve that is substantially coaxial with the axis of the rotor shaft 332. The second end 354 is substantially unsupported.

Referring primarily now to FIG. 4, the actuator 300 includes a seal carrier assembly 360. In some embodiments, the seal carrier assembly 360 can be the seal carrier assembly 105 of FIG. 1. The seal carrier assembly 360 includes a pivot member 362 rotatably affixed to the housing 302 of the actuator 300. The seal carrier assembly 360 also includes a head 363 having a face portion 364 and an aperture 366 defined through the face portion 364. The aperture 366 is sized to allow the rotary piston 350 to pass through. The aperture 366 includes a seal groove 368, and a piston seal 370 rests in the seal groove 368 to provide sealing contact between the head 636, proximal to the face portion 364, and the rotary piston 350 (e.g., piston seal is disposed about an interior surface of the third open end). The seal carrier assembly 360 is configured to pivot slightly about the pivot member 362, such that the face portion 364 travels in an arc section about the pivot member 362. The face portion 364 is formed with a curve that substantially matches the face portion's 364 arc of travel about the pivot member 362.

The pressure chamber includes an opening 342 defined in a face portion 344 of the pressure chamber assembly 320. The face portion 344 is formed with curvature that substantially compliments the face portion 364, such that the face portion 344 substantially mates with the face portion 364. A seal groove 322 is formed about an opening 342 to the cavity 340 formed in the face portion 364, and a face seal 324 rests in the seal groove 322. The face seal 324 is in sealing contact between the face portion 344 and the face portion 364. As such, the cavity 340, the aperture 366, the piston seal 370, the face seal 324, the head 363, and the rotary piston 350 define a pressure chamber in the pressure chamber assembly 320.

In some implementations, the piston seal 370 and/or the face seal 324 can be a circular or semi-circular sealing geometry retained on all sides in a standard seal groove. In some implementations, commercially available reciprocating piston or cylinder type seals can be used. For example, commercially available seal types that may already be in use for linear hydraulic actuators flying on current aircraft may demonstrate sufficient capability for linear load and position holding applications. In some implementations, the sealing complexity of the actuator 100 may be reduced by using a standard, e.g., commercially available, semi-circular, unidirectional seal designs generally used in linear hydraulic actuators. In some embodiments, the piston seal 370 and/or the face seal 324 can be a one-piece seal.

FIGS. 3 and 4 show the example actuator 300 with the rotary piston 350 in a partly extended configuration. Referring primarily again to FIG. 4, a pressurized fluid is applied to a fluid port (not shown) to pressurize an arcuate cavity 340 formed in the pressure chamber assembly 320. Pressure in the cavity 340 urges the rotary piston 350 partly outward, urging the rotor shaft 332 to rotate in a first direction, e.g., counter-clockwise. Mechanical rotation of the rotor shaft 332 in a second direction, e.g., clockwise, urges the rotary piston 350 partly inward. Fluid in the cavity 340 displaced by the rotary piston 350 flows out through the fluid port.

In some embodiments, one or more of the rotary pistons 150 and/or 350 can be at least partly hollow in cross-section. In some embodiments, one or more of the rotary pistons 150 and/or 350 can include a structural member inside the piston, located between two cavities inside the piston. In some embodiments, one or more of the rotary pistons 150 and/or 350 can have one of a square, rectangular, ovoid, elliptical, or circular shape in cross-section. For example, the rotary pistons 150 and 350 can experience radial deformation under high pressures and/or loads. In order to at least partly resist such deformation, the rotary pistons 150 and/or 350 can be formed with radial thicknesses that are greater than their axial widths.

FIGS. 5A-5D are perspective, rear, top, and side views of an example seal carrier assembly 500. In some embodiments, the seal carrier assembly 500 can be the example seal carrier assembly 105 of FIGS. 1 and 2, or the example seal carrier assembly 360 of FIGS. 3 and 4.

The seal carrier assembly 500 includes a pivot member 502 that is configured to be rotatably affixed to a housing of a rotary piston actuator, such as the pressure chamber assembly 120 of FIG. 1, or the housing 302 of the actuator 300. The seal carrier assembly 500 also includes a head 504 having a face portion 510 and an aperture 516 defined through the face portion 510. The aperture 516 is sized to allow a rotary piston, such as the example rotary pistons 150 or 350 to pass through. The aperture 516 includes a seal groove 518 (visible in FIGS. 5A and 5C) configured to accommodate a face seal (e.g., the example face seal 324) to provide sealing contact between the face portion 510 and the face portion 344. The seal carrier assembly 500 is configured to pivot slightly about the pivot member 502, such that the face portion 510 travels in an arc section about the pivot member 502. The face portion 510 is formed with a curve that substantially matches the face portion's 510 arc of travel about the pivot member 502.

Returning now to FIGS. 3 and 4, the function of the example seal carrier assembly 360 will be explained in more detail. Under ideal operational circumstances, pressurization of fluid in the cavity 340 will urge movement of the rotary piston 350 outward from the cavity in a substantially circular arc. Under such idealized conditions, the rotary piston 350 glides through the opening 342 in sealing contact with the piston seal 370. Very little lateral force is exhibited by the rotary piston 350 upon the piston seal 370 under such idealized conditions and, as such, relatively little friction is caused. However, under non-ideal, real-world conditions, high pressures in the cavity 340 and/or stresses placed upon the rotor shaft 332 can cause the rotary piston 350 to distort or otherwise cause the second end 354 to move radially (e.g., outward) away from the rotor shaft 332 as well as rotationally about the rotor shaft 332. Since the rotary piston 350 is affixed to the rotor arm 334 at a predetermined angle at the first end 352, such deflection is least pronounced near the first end 352, but can become more and more pronounced along the rotary piston away from the first end 352 and toward the second end 354, which is substantially unsupported.

In previous rotary actuator designs, the locations of the mouths of pressure chambers and seals are mechanically fixed. Deflection of such rotary pistons cause a misalignment between such pistons and the seals, in which such pistons place increasing radial loads against such seals. As such rotary pistons extend, the load and friction against their corresponding piston seals can increase, causing a corresponding loss in torque that increases with the angle of rotation. The actuator 300, however, includes the seal carrier assembly 360 that accommodates radial distortions of the rotary piston 350 and reduces the resulting effects.

In operation, the head 363 of the seal carrier assembly 360 is able to pivot slightly on the pivot member 362, allowing the aperture 366 and the piston seal 370 to move radially relative to the rotor shaft 332. As the rotary piston 350 distorts radially outward, the seal carrier assembly 360 pivots to allow the aperture 366 to follow the radial travel of the rotary piston 350. The face portion 344 is formed with a curvature that substantially compliments the face portion 364, such that the face portion 344 substantially mates with the face portion 364, and glides across the face seal 324 to retain pressure within the cavity 340 as seal carrier assembly 360 moves relative to the pressure chamber assembly 320.

Since the aperture 366 is able to move with the rotary piston 350, force between the rotary piston 350 and the piston seal 370 does not substantially increase. By avoiding the increase in force between the rotary piston 350 and the piston seal 370, substantially no additional friction is caused between the rotary piston 350 and the piston seal 370. Since substantially no additional friction is caused as the rotary piston 350 extends, there is substantially no additional torque loss as the rotary output assembly 330 rotates from low angles of rotation to high angles of rotation. As such, the actuator 300 provides a substantially constant delivery of torque over stroke.

Figure 6:
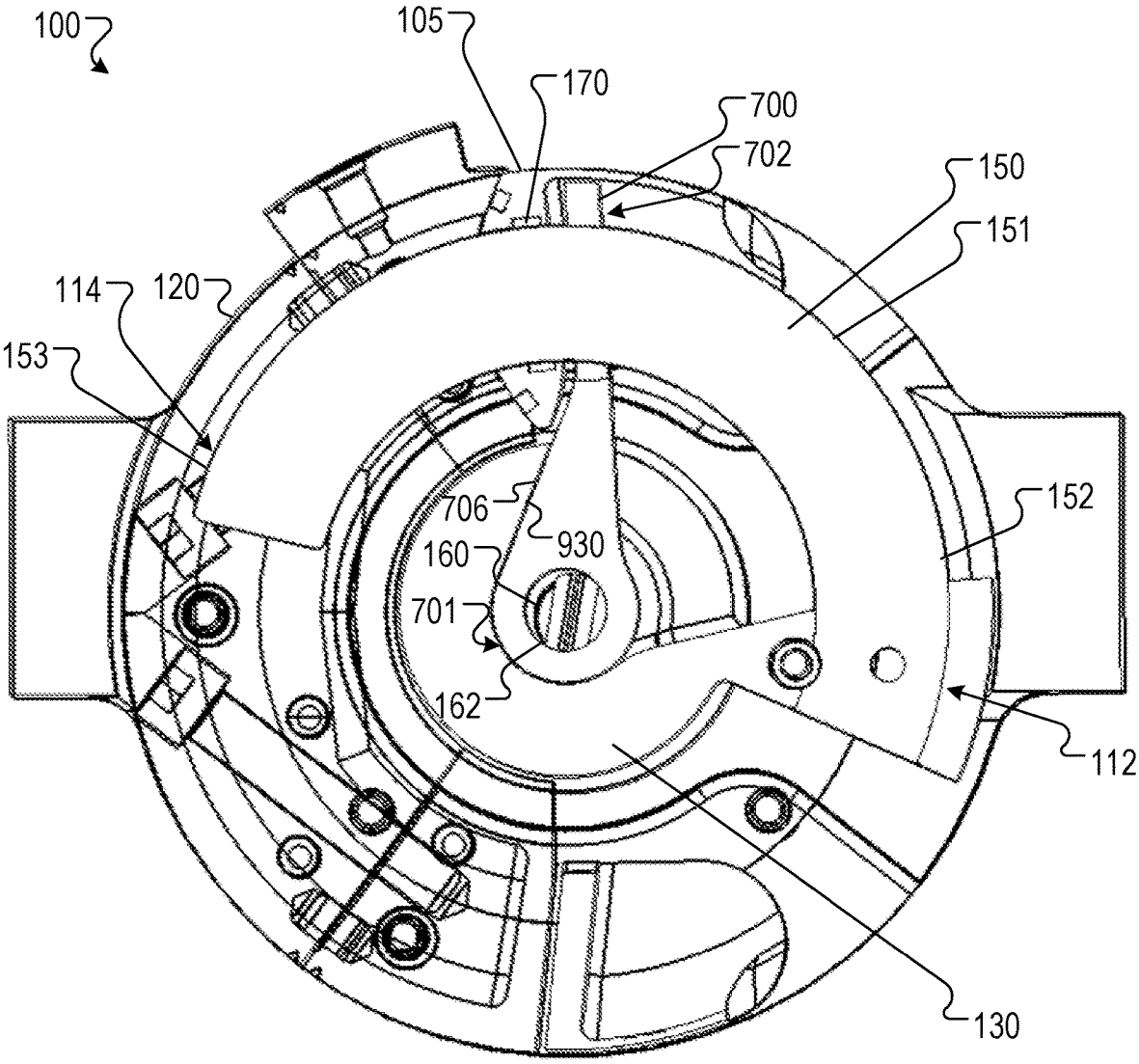
FIG. 6 is a sectional side view of the example rotary piston actuator of FIG. 1.
Figure 7A:
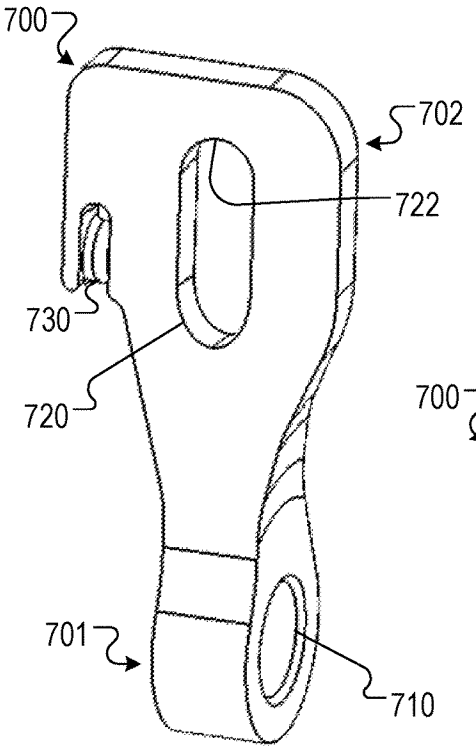
FIGS. 7A-7D are perspective, top, front, and side views of an example load bearing assembly.
Figure 7B:
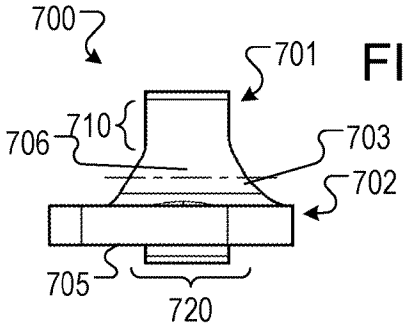
Figure 7C:
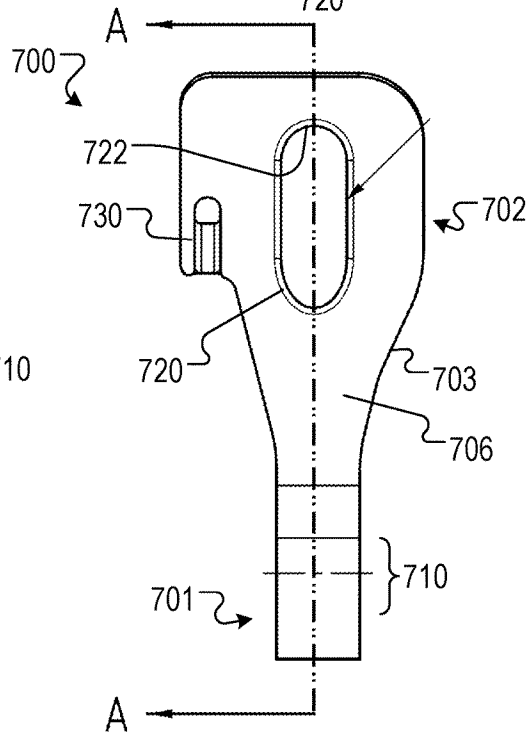
Figure 7D:
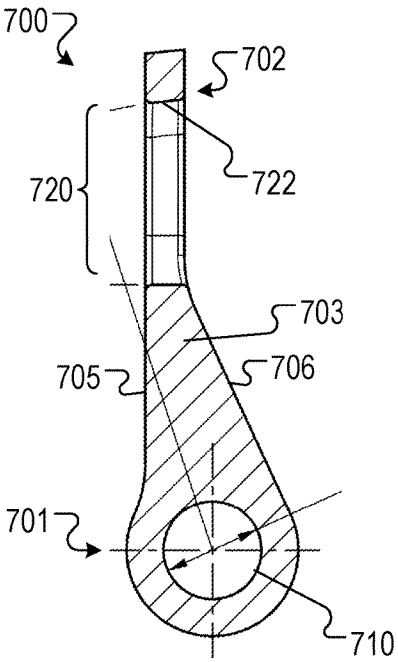
Figure 8A:
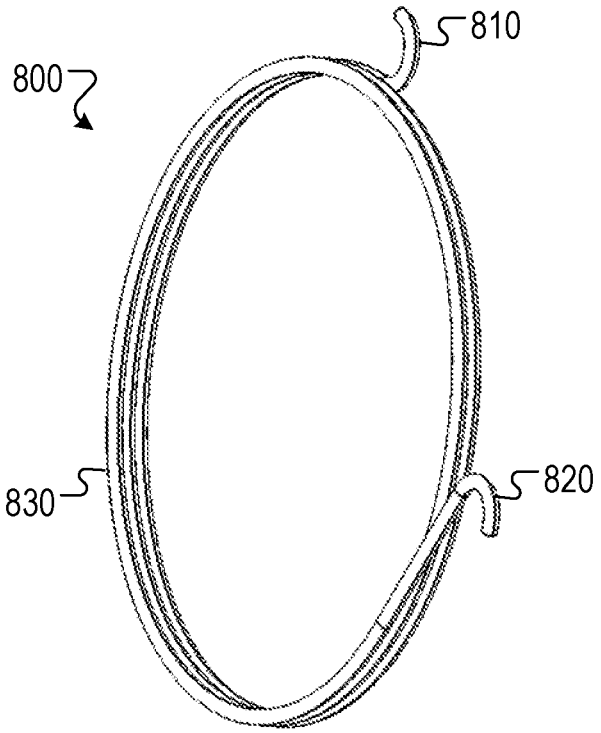
FIGS. 8A and 8B are perspective and side views of an example spring member.
Figure 8B:
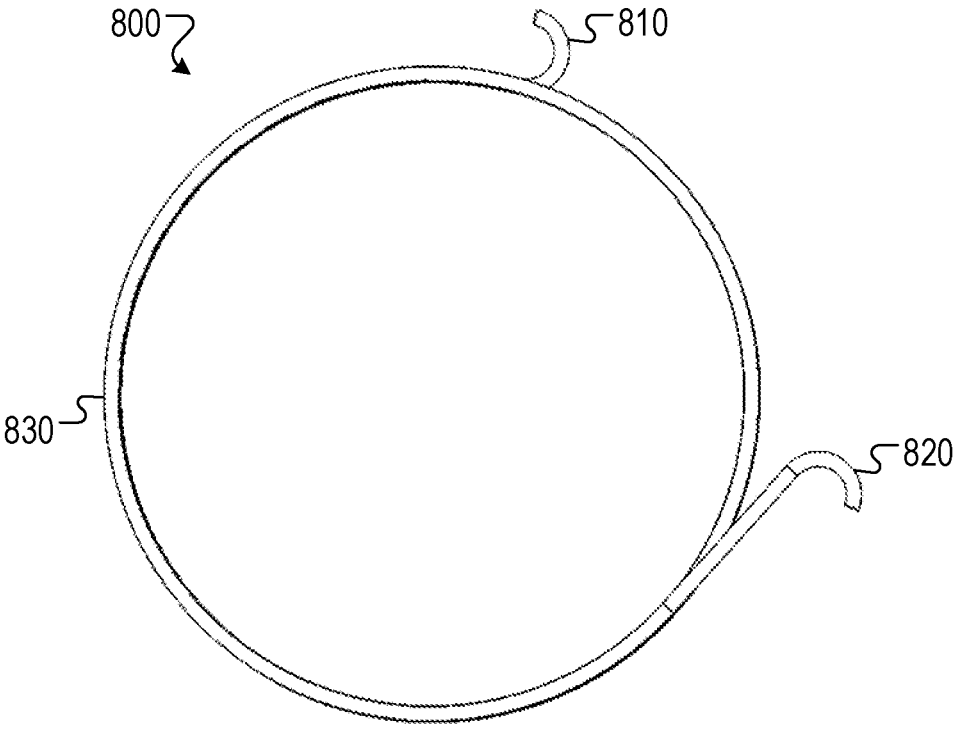

FIG. 6 is a sectional side view of the example rotary piston actuator 100 of FIG. 1. Visible in this view, as well as in FIG. 1, is the pressure chamber assembly 120. Visible in this view, as well as in FIGS. 1 and 2, are the rotary output assembly 130, the rotary piston 150, the central shaft 162, the seal carrier assembly 105, and the load bearing assembly 700.

FIGS. 7A-7D are perspective, top, front, and side views of the example load bearing assembly 700. The load bearing assembly 700 includes a lower end 701 and an upper end 702. The lower end 701 is a substantially cylindrical structure. The upper end 702 extends from the lower end 701 along a body 703 with a shape that transitions from having the cylindrical shape of the lower end 701 to having a planar shape at its distal end, in which the plane is substantially co-planar to the axis of the cylindrical shape of the lower end 701. The body 703 has a rear face surface 705 and a front face surface 706 opposite the rear face surface 705. A bore 710 is formed though the lower end 701, and an aperture 720 is formed through the plane of the upper end 702. The aperture 720 is oriented substantially perpendicular to the bore 710. The bore 710 is formed to act as a hinge about the central shaft 160. The aperture 720 is sized to accommodate the rotary piston 350 and includes a radially inward surface 722. The upper end 702 also includes a recess 730 formed to at least partly retain the spring member 800. The recess 730 is discussed further in the description of FIGS. 8A and 8B.

Figure 9A:
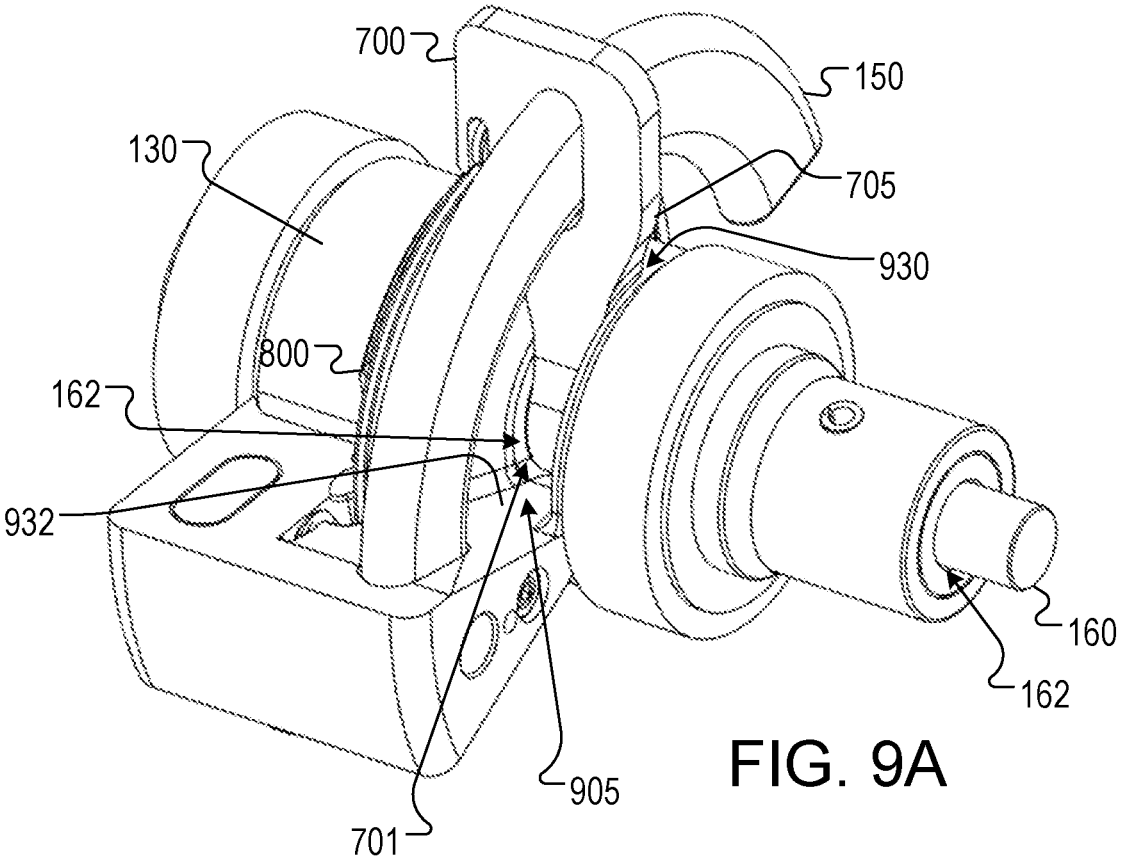
FIGS. 9A and 9B are perspective views of the example rotary output assembly of FIG. 1.
Figure 9B:
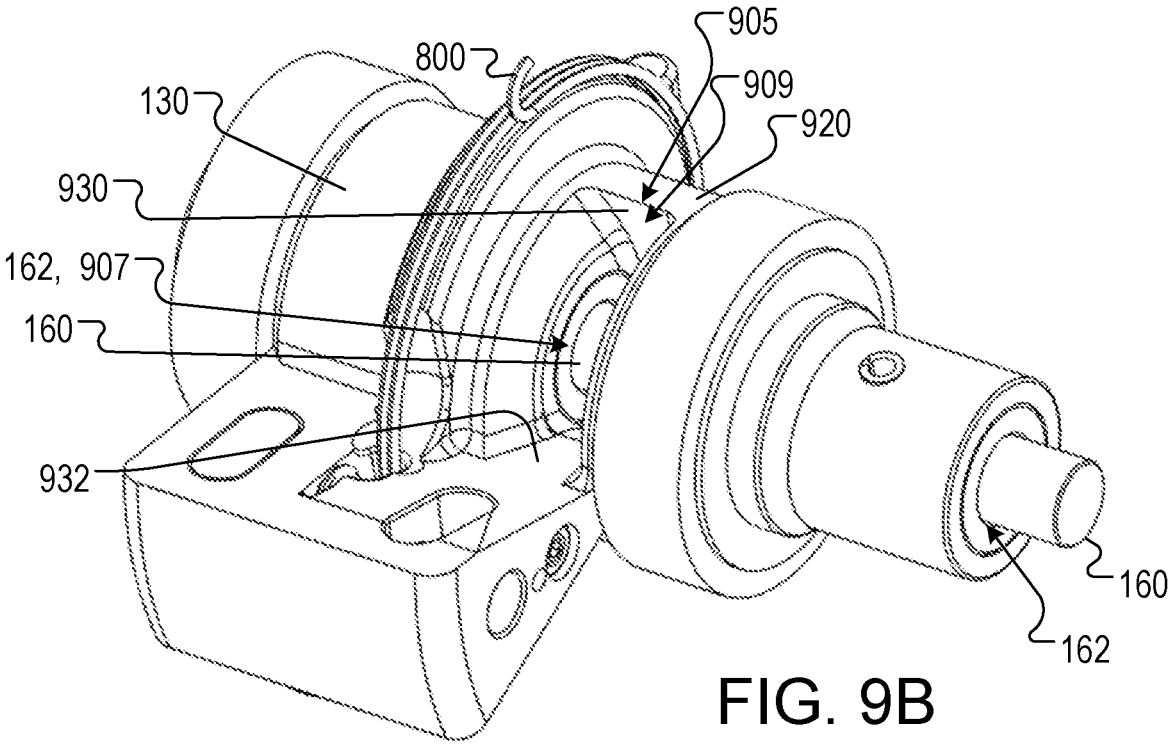

FIGS. 9A and 9B are perspective views of the example rotary output assembly 130 of FIG. 1. FIG. 9A shows the rotary output assembly 130, one of the rotary pistons 150, the central shaft 160, the spring member 800, and one of the load bearing assemblies 700 to show their relative positions to each other when assembled. FIG. 9B shows the rotary output assembly 130, the spring member 800, and the central shaft 160. The rotary piston 150 and the load bearing assembly 700 are hidden from view in FIG. 9B to provide a better view of an aperture 905 formed in the rotary output assembly 130.

Referring primarily to FIG. 9B, the aperture 905 is a semi-circular, wedge-shaped (e.g., shaped like a pie slice) opening formed though the rotary output assembly 130. The aperture extends radially from a radially inward opening 907 to the central bore 162 to a radially outward opening 909 in a cylindrical outer surface 920 of the rotary output assembly 130. The aperture 905 is bounded on one end by a radial face 930 and is bounded on the rotationally opposite end by a radial face 932.

Referring back to FIG. 9A, the load bearing assembly 700 is configured for reciprocal movement (e.g., pivot) about the central shaft 160 within the aperture 905 between the radial face 930 and the radial face 932. The radial face 930 is configured to contact the rear face surface 705 of the load bearing assembly 700 when the load bearing assembly 700 travels to that end of the aperture 905. The rotary output assembly 130 is configured to rotate independently of the load bearing assembly 700 (e.g., urged by movement of the rotary piston 150) until the rear face surface 705 contacts the radial face 930, at which point further rotation of the rotary output assembly 130 will urge rotation of the load bearing assembly 700 at substantially the same rotational velocity as the rotary piston 150 based on the contact between the rear face surface 705 and the radial face 930.

In some embodiments, the radial face 930 can be arranged to have a radial alignment having a predetermined position relative to the rotary piston 150. For example, simulation or field testing may determine that radial deformation of the rotary piston 150 may be best constrained by having the load bearing assembly 700 in position to be contacted by the rotary piston 150 at a point that is halfway (e.g., +/−10%) along the length of the rotary piston. As such, the aperture 905 can be formed such that when the radial face 930 is in contact with the rear face surface 705, the load bearing assembly 700 will be substantially aligned with the predetermined position on the rotary piston 150 (e.g., about halfway along the length of the rotary piston 150) in order to constrain radial deformation of the rotary piston 150 should it occur. In other examples, it may be determined that the contact point should be at any other appropriate location along the rotary piston 150 (e.g., ⅓, ⅔, ¼, ¾, or any other appropriate location along the length of the rotary piston 150).

Referring back to FIG. 6, the load bearing assembly 700 is shown assembled to the actuator 100. The central extends through the bore 710 such that the load bearing assembly 700 can pivot coaxially about the central shaft 162 relative to, but independent from, the rotor assembly 130 and the rotary piston 150. As is visible in both FIG. 1 and FIG. 6, the rotary piston 150 passes through the aperture 720 such that the radially inward surface 722 faces a radially outward surface 151 of the rotary piston 150. The radially outward surface 151 defines a portion of a first arc (e.g., a portion of a circle) having a first radius, and under low or zero load the radially outward surface 151 will travel along the first arc as the rotary piston 150 moves in and out of the rotary output assembly 130. However, as discussed previously, under high pressures and/or loads, the rotary piston 150 can exhibit radial as well as orbital motion, in which a first radially outward surface portion 152 of the radially outward surface 151 near a first end 112 more closely follows the first arc, while a second radially outward surface portion 153 of the radially outward surface 151 near a second end 114 can follow a second arc that has a variable second radius away from the axis (e.g., varying depending on pressure and/or loading).

The radially inward surface 722 is spaced radially apart from the rotary piston 150, and is configured for reciprocal movement along a third arc that is coaxial to the first arc. The radially inward surface 722 and the third arc has a third radius from the axis that is radially larger than the first radius and is radially smaller than a portion of the variable second radius. Under low pressures and/or loads, the rotary piston 150 can move such that the first end 112 and the second end 114 move in substantially the same circular path, without contacting or otherwise interfering with the radially inward surface 722. However, under higher pressures and/or loads the second end 114 can move radially outward, causing second radially outward surface portion 153 to move along an arc having a radius that is larger than the first radially outward surface portion 152.

Under sufficiently high pressures and/or loads, the radius of the second radially outward surface portion 153 can equal or exceed the radius of the radially inward surface 722. Under such conditions, the radially outward surface 151 of the rotary piston 150 can contact or otherwise mechanically interfere with the radially inward surface 722. With the rotary piston 150 in contact with the load bearing assembly 700, the load bearing assembly 700 transmits the force of the rotary piston 150 to the pressure chamber assembly 120 or other housing portions of the actuator 100 (or the housing 302 of the actuator 300) and constrains the portion of the rotary piston 150 in contact with the load bearing assembly 700 from further radial motion. As the rotary piston 150 extends, it urges rotation of the rotary output assembly 130. As the rotary output assembly 130 rotates, the radial face 930 is brought into contact with the rear face surface 705 and will urge (e.g., pull, drag) the load bearing assembly 700 to pivot and follow the orbit of the rotary piston 150 at substantially the same speed and direction as the rotary piston 150. With radial motion of the rotary piston 150 constrained, the rotary piston 150 imparts substantially no additional radial (e.g., lateral) force against a rotary piston seal 170 (e.g., the piston seal 370) and therefore substantially no additional friction between the rotary piston 150 and the rotary piston seal 170 will be caused and will exhibit substantially none of the resulting torque loss as a result. As such, the rotary output assembly 130 can be rotated with substantially constant torque over the range of stroke of the rotary piston 150.

As the rotary piston 150 moves back into the pressure chamber assembly 120 (e.g., as the length of stroke shortens), as pressures drop, and/or as loads on the rotary output assembly 130 are reduced, the rotary piston 150 can come out of contact with the radially inward surface 722. Under such conditions, the load bearing assembly 700 disengages the rotary piston 150 and can pivot about the lower end 701 independently from the rotary piston 150.

In some embodiments, the load bearing assembly 700 may be connected to the pressure chamber assembly 120 without use of the lower end 701. For example, the upper end 702, or a portion thereof that defines a functional equivalent of the radially inward surface, can slide along a track defined in the pressure chamber assembly 120 or other housing member to follow the arc of rotation of the rotary piston 150.

In some embodiments, the load bearing assembly 700 and the seal carrier assembly 105 can be used together, as shown in the example actuator 100. In some embodiments, the load bearing assembly 700 may be used without the seal carrier assembly 105, or the seal carrier assembly 105 can be used without the load bearing assembly 700.

FIGS. 9A and 9B are perspective and side views of the example spring member 800 that is also visible in FIGS. 1 and 2. The spring member 800 includes a first end 810 connected to a second end 820 through a coil 830.

As discussed previously, under some circumstances, the load bearing assembly 700 can pivot independent from the rotary piston 150. For example, at low rotational strokes, when the direction of resultant fluid pressure forces on the piston is such that there is little radial deformation of the rotary piston, the load bearing assembly 700 may move independently of the rotary piston 150 (e.g., when the load bearing assembly 700 is not needed to transmit radial forces away from the rotary piston 150). Referring back to FIG. 1, the second end 820 contacts the pressure chamber assembly 120, and the first end 810 rests in the recess 730 of the load bearing assembly 700. The spring member 800 is arranged to provide a bias force against the load bearing assembly 700 and urge pivotal movement of the load bearing assembly 700 toward the radial face 930 of the aperture 905 of the rotary output assembly and the open end of the pressure chamber assembly 120 (e.g., the open end 342). As such, the load bearing assembly 700 is kept near the opening until the radial face 930 is rotated into contact with the rear face surface 705. When the rotary output assembly is rotated in the opposite direction (e.g., retracting the rotary piston 150), the bias of the coil 830 will urge the load bearing assembly 700 back into contact with the radial face 930 and follow the movement of the radial face 930, at substantially the same speed and direction as the rotary piston 150, back toward the opening of the pressure chamber assembly 120 to be in position for the load bearing assembly's 700 next actuation. In some embodiments, the front face surface 706 may rest against the seal carrier assembly 150 or a hard stop, after which the rotary output assembly 130 can continue to rotate in the opposite (e.g., retracting) direction, separating the radial face 930 from the rear face surface 705 while biasing the spring member 800. A key advantage of this load bearing solution is that it provides the function of load bearing without causing any torque loss when needed at high strokes, regardless of fluid pressure fluctuations, rotary motion oscillations, inertial g-forces due to vibration, etc. Another advantage is that at low strokes it does not hamper motion or substantially reduce the maximum stroke of the rotary actuator.

Figure 10:
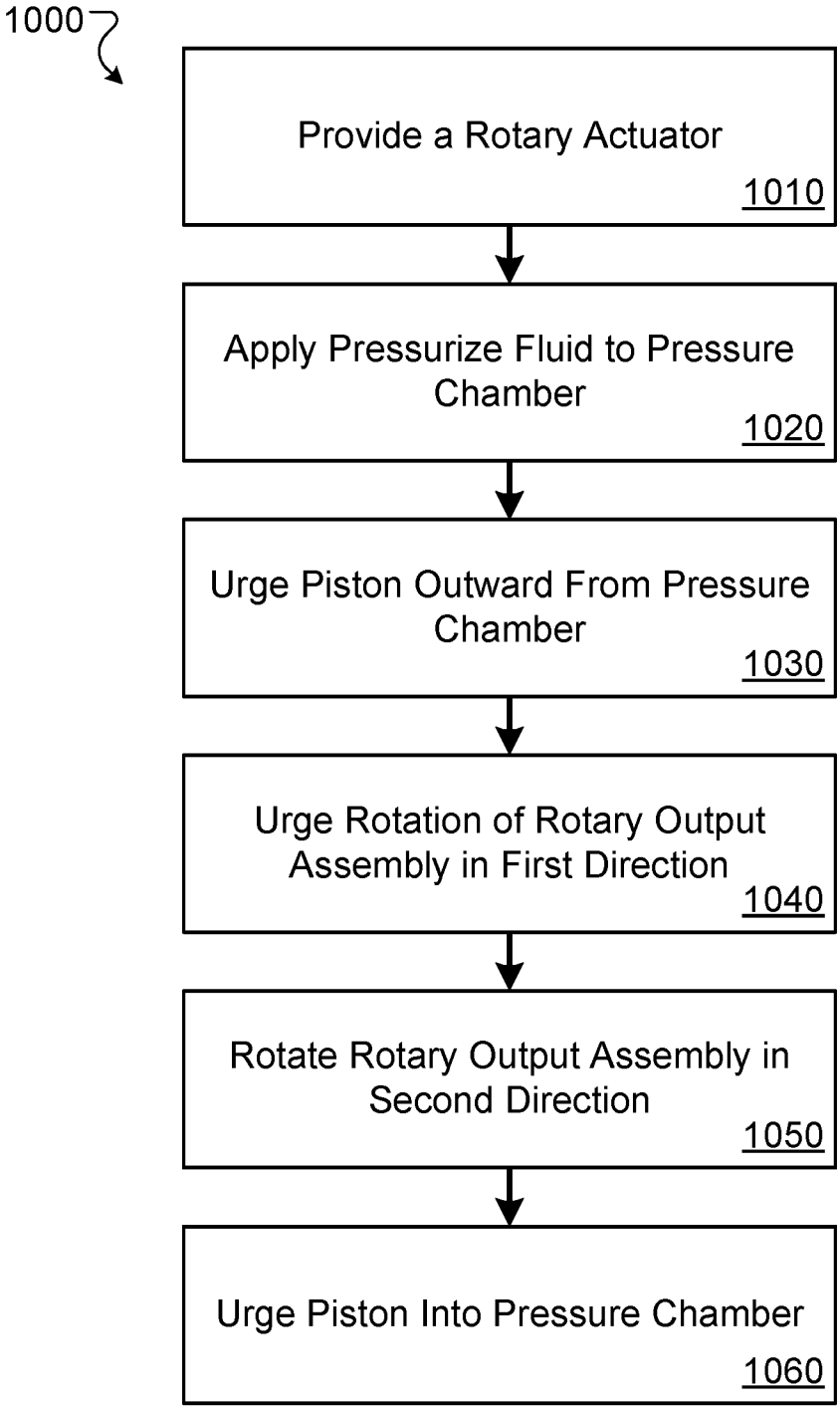
FIG. 10 is a flow diagram of an example process for performing rotary actuation.

FIG. 10 is a flow diagram of an example process 1000 for performing rotary actuation. In some implementations, the process 900 can be performed by the example rotary actuator 100 of FIG. 1 or the example rotary actuator 300 of FIG. 3.

At 1010, a rotary actuator is provided. The rotary actuator includes a housing defining a first arcuate chamber portion and comprising a first cavity, a first open end, and a first fluid port in fluid communication with the first cavity, a first seal carrier assembly defining a second arcuate chamber portion and comprising a second cavity in fluid communication with the first cavity, a first piston seal, a second open end, and a third open end opposite the second open end, a first face seal in sealing contact with the first housing proximal to the first open end and the second open end, a rotary output assembly, and an arcuate-shaped first piston disposed in said first housing for reciprocal movement in the first arcuate chamber portion and in the second arcuate chamber portion through the first open end, the second open end, and the third open end, wherein the first piston seal, the first face seal, the first cavity, the second cavity, and the first piston define a first pressure chamber, and a first portion of the first piston contacts the rotary output assembly. For example, the rotary actuator 100 or the rotary actuator 300 can be provided.

At 1020 pressurized fluid is applied to the first pressure chamber. For example, pressurized fluid can be applied to the cavity 340.

At 1030, the first piston is urged partially outward from the first pressure chamber to urge rotation of the rotary output assembly in a first direction 1040. For example, fluid pressure in the cavity 340 can urge the rotary piston 350 partly outward from the pressure chamber assembly 320, thereby causing the rotary output assembly 330 to rotate.

At 1050, the rotary output assembly is rotated in a second direction opposite that of the first direction, and at 1060 the first piston is urged partially into the first pressure chamber to urge pressurized fluid out the first fluid port. For example, the rotary output assembly 330 can be rotated to cause the rotary piston 350 to move into the cavity 340, where fluid displaced by the rotary piston 350 in the cavity 340 flows out through a fluid port (not shown).

In some implementations, the process 1000 can also include urging, by the first piston, movement of the first seal carrier assembly relative to the housing. For example, the seal carrier assembly 360 can move (e.g., pivot radially) relative to the housing 302.

In some embodiments, the housing can also define a third arcuate chamber portion having a third cavity, a fourth open end, and a second fluid port in fluid communication with the third cavity, and the rotary actuator can also include a second seal carrier assembly defining a fourth arcuate chamber portion having a fourth cavity in fluid communication with the third cavity, a second piston seal, a fifth open end, and a sixth open end opposite the fifth open end, a second face seal in sealing contact with the first housing proximal the fourth open end and the fifth open end, and can include an arcuate-shaped second piston disposed in said first housing for reciprocal movement in the third arcuate chamber portion and in the fourth arcuate chamber portion through the fourth open end, the fifth open end, and the sixth open end, wherein the second piston seal, the second face seal, the third cavity, the fourth cavity, and the second piston define a second pressure chamber, and a first portion of the second piston contacts the rotary output assembly. In some embodiments, the second piston can be oriented in the opposite rotational direction as the first piston. For example, the actuator 100 includes the two rotary pistons 150 and corresponding pressure chambers, in which one of the rotary pistons 150 is configured to rotate the rotary output assembly 330 in a first direction (e.g., clockwise) and the other rotary piston 150 is configured to rotate the rotary output assembly 330 in a second, opposite direction (e.g., counterclockwise).

In some embodiments, the rotary actuator can include an outer housing disposed about the housing and having a second fluid port, wherein the outer housing, the housing, the first piston seal, and the first piston define a second pressure chamber. In some implementations, rotating the rotary output assembly in a second direction opposite that of the first direction can include applying pressurized fluid to the second pressure chamber, and urging the first piston partially into the first pressure chamber to urge rotation of the rotary output assembly in a second direction opposite from the first direction.

In some implementations, urging the first piston partially outward from the first pressure chamber to urge rotation of the rotary output assembly in a first direction further can include rotating the output assembly in the first direction with substantially constant torque over stroke. For example, the seal carrier assembly 360 can comply with radial movement of the rotary piston 350 to reduce the amount of force applied to the piston seal 370, reducing or avoiding the amount of torque-reducing friction caused by such force.

In some embodiments, the first seal can be disposed about an interior surface of the third open end. For example, the piston seal 370 rests in the seal groove 368 within the aperture 366.

In some embodiments, the first piston can be removably affixed to and extending from the rotary output assembly at a predetermined angle to the rotary output assembly. For example, the rotary piston 350 is removably affixed to the rotor arm 334 at the first end 352 of the rotary piston 350 at a predetermined angle (e.g., perpendicular) to the rotor arm 334.

Figure 11:
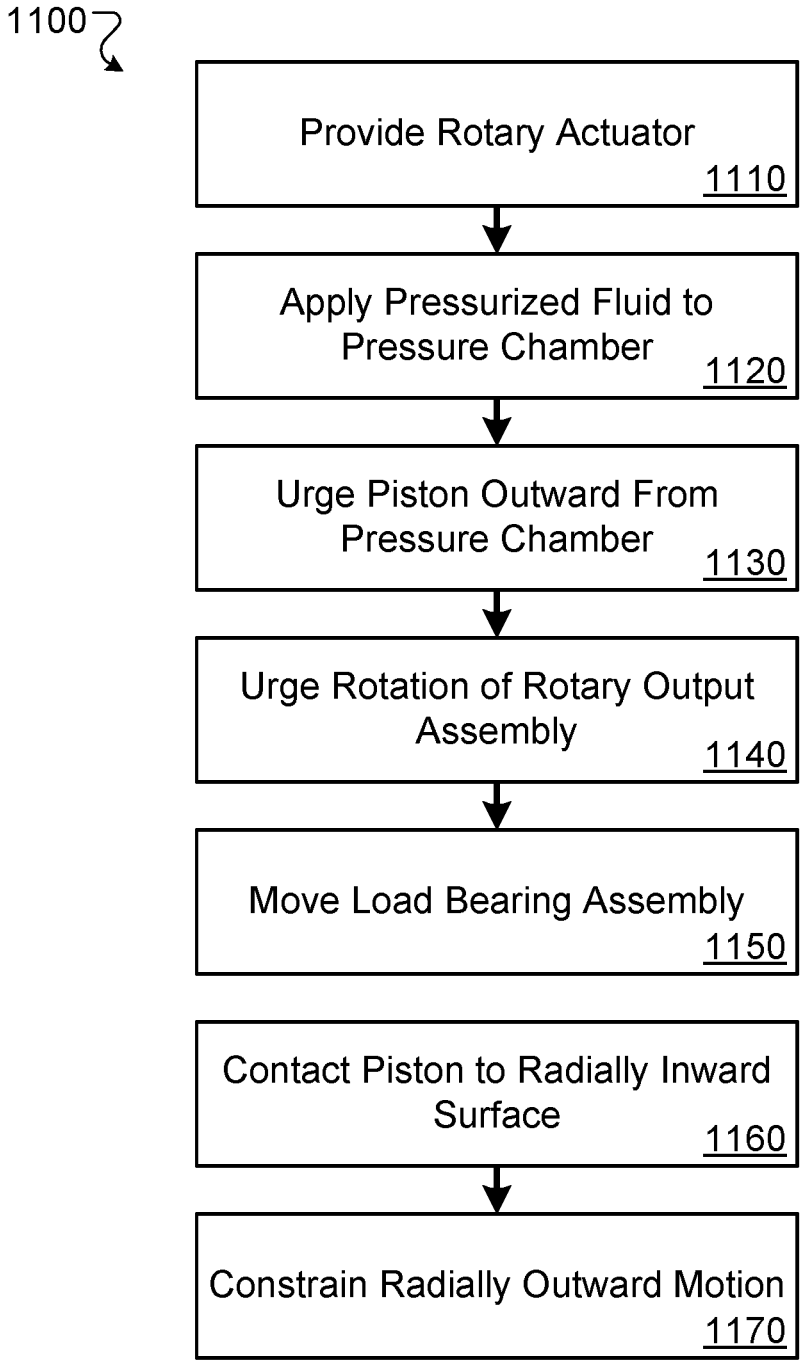
FIG. 11 is a flow diagram of another example process for performing rotary actuation.

FIG. 11 is a flow diagram of another example process 1100 for performing rotary actuation. In some implementations, the process 1100 can be performed by the example rotary actuator 100 of FIG. 1.

At 1110, a rotary actuator is provided. The rotary actuator includes a housing defining a first arcuate chamber and comprising a cavity, a fluid port in fluid communication with the cavity, and an open end, a rotary output assembly, an arcuate-shaped piston extending from a first piston portion affixed to the rotary output assembly to a second piston portion spaced apart from rotary output assembly, disposed in said housing for reciprocal movement in the arcuate chamber through the open end, wherein a seal, the cavity, and the piston define a pressure chamber, and, a load bearing assembly comprising a radially inward surface facing, and spaced radially apart from, the piston. For example, the rotary actuator 100 can be provided.

At 1120, pressurized fluid is applied to the pressure chamber. For example, pressurized fluid can be applied to a cavity (not shown, such as the cavity 340 of FIG. 3) formed in the pressure chamber assembly 120.

At 1130, the piston is urged partially outward from the pressure chamber. At 1140, the piston urges rotation of the rotary output assembly in a first direction. For example, fluid pressure in the chamber defined in the pressure chamber assembly 120 can urge the rotary piston 150 partly outward from the pressure chamber assembly 120, thereby causing the rotary output assembly 130 to rotate.

At 1150, the load bearing assembly is moved into alignment with a predetermined load bearing position relative to the piston. For example, as shown in FIG. 9A, the aperture 905 can be formed such that when the radial face 930 is rotated into contact with the rear face surface 705, the load bearing assembly 700 will be urged to rotate along with the rotary output assembly 130 in alignment with a predetermined position on the rotary piston 150 (e.g., about halfway along the length of the rotary piston 150 in the example of FIG. 9A) in order to constrain radial deformation of the rotary piston 150 near the predetermined location should it occur, as the rotary output assembly 130, the rotary piston 150, and the load bearing assembly 700 move together, substantially as a unit, starting at the predetermined point of extension of the rotary piston 150 (e.g., about halfway extended) and beyond.

At 1160, the piston contacts the radially inward surface. In some implementations, the process 1100 can include urging radial movement of a portion of the piston in a radially outward direction, wherein contact between the piston and the radially inward surface is based on the radial movement in the radially outward direction. For example, under sufficiently high pressures and/or loads, the radius of the second radially outward surface portion 153 can equal or exceed the radius of the radially inward surface 722 causing the radially outward surface 151 of the rotary piston 150 to contact or otherwise mechanically interfere with the radially inward surface 722.

At 1170, the load bearing assembly constrains radially outward motion of the second radially outward surface portion, based on the contacting. For example, with the rotary piston 150 in contact with the load bearing assembly 700, the load bearing assembly 700 can transmit the force of the rotary piston 150 to the pressure chamber assembly 120 or other housing portions of the actuator 100 and can constrain the portion of the rotary piston 150 in contact with the load bearing assembly 700 from further radial motion.

In some implementations, the process 1100 can also include urging, by the rotary output assembly, movement of the load bearing assembly at substantially the same speed and direction as the piston. For example, the load bearing assembly 700 can pivot along with the rotary piston 150 and the rotary output assembly 130. In some implementations, the rotary actuator can also include a rotor shaft and the load bearing assembly can include a hinge at a proximal end configured for reciprocal movement upon the rotor shaft, wherein the rotary output assembly rotates concentrically about the rotor shaft and can define a radial aperture having a first radial face, and the load bearing assembly can include a body extending from the hinge through the radial aperture to a distal end having the radially inward surface, the body having a second radial face configured to contact the first radial face, wherein urging movement of the load bearing assembly at substantially the same speed and direction as the piston can include contacting the first radial face to the second radial face. For example, the rotary output assembly 130 can rotate to bring the radial face 930 into contact with the rear face surface 705, after which further rotation of the rotary output assembly 130 will urge movement of the load bearing assembly 700 in the same direction and at substantially the same speed as the rotary piston 150 and the rotary output assembly 130.

In some implementations, the process 1100 can also include urging rotation of the rotary output assembly in a second direction opposite the first direction, urging, by rotation of the rotary output assembly in the second direction, the piston partially into the pressure chamber, and separating the piston from contact with the radially inward surface. In some implementations, the process 1100 can also include comprising urging radial movement of a portion of the piston in a radially inward direction, wherein separation of the piston from the radially inward surface is based on the radial movement in the radially inward direction. In some implementations, the process 1100 can also include urging, by the rotary output assembly 130, movement of the load bearing assembly in a second direction opposite the first direction at substantially the same speed as the piston 150. For example, as the rotary piston 150 moves back into the pressure chamber assembly 120, the spring member 800 urges the load bearing assembly 700 toward contact with the radial end 930, to follow the rotational direction and speed of the rotary output assembly 130 and the rotary piston 150.

In some implementations, the process 1100 can also include biasing, based on the movement of the load bearing assembly in the first direction, a spring member arranged to provide a bias force against the load bearing assembly, and urging, by the bias force, movement of the load bearing assembly in a second direction opposite the first direction. For example, the spring member 800 can be arranged to provide a bias force against the load bearing assembly 700 and urge pivotal movement of the load bearing assembly 700 toward the open end of the pressure chamber assembly 120 (e.g., the open end 342).

In some implementations, urging, by the piston, rotation of the rotary output assembly can include rotating the rotary output assembly with substantially constant torque over stroke. For example, since the load bearing assembly 700 is able to move with the rotary piston 150, force between the rotary piston 150 and the piston seal 370 does not substantially increase. By avoiding the increase in force between the rotary piston 150 and the rotary piston seal 170, substantially no additional friction is caused between the rotary piston 150 and the rotary piston seal 170. Since substantially no additional friction is caused as the rotary piston 150 extends, there is substantially no additional torque loss as the rotary output assembly 130 rotates from low angles of rotation to high angles of rotation. As such, the actuator 100 can provides a substantially constant delivery of torque output over piston stroke.

Although a few implementations have been described in detail above, other modifications are possible. For example, the example actuator 100 may include one, two, three, four, or more rotary pistons arranged to in the same direction (e.g., cooperative), opposite direction, or combinations of both. In another example, multiples of the actuator 100 can be arranged along a common axis. In another example, fluid may enter and exit the cavity 340 through a fluid circuit provided in the rotary output assembly 330 (e.g., through the rotor shaft 332). In another example, the actuator 100 and/or 300 may also include an outer housing disposed about the housing (e.g., the pressure chamber assemblies 120 and/or 320), and the outer housing can have a second fluid port, wherein the outer housing, the housing, the first piston seal, and the first piston can define a second pressure chamber. In another example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A rotary actuator comprising:

a housing defining an arcuate chamber portion and comprising a first cavity, a housing face portion having a first curvature, and an open end defined in the housing face portion;

a seal carrier assembly defining a second arcuate chamber portion and comprising a carrier face portion having a second curvature that matches the first curvature, an aperture defined through the carrier face portion, a face seal groove defined in the carrier face portion, a piston seal groove defined in the aperture, a pivot member rotatably affixed to the housing and configured to permit the seal carrier assembly to pivot about the pivot member relative to the housing such that the carrier face portion travels in an arc section having a third curvature that matches the second curvature, a second cavity in fluid communication with the first cavity, a piston seal arranged within the piston seal groove, and a face seal arranged within the face seal groove in sealing contact between the carrier face portion and the housing face portion proximal to the open end and the aperture;

a rotary output assembly; and an arcuate-shaped piston disposed in said housing for reciprocal movement in the arcuate chamber portion and in the second arcuate chamber portion through the open end and the aperture, wherein the piston seal, the face seal, the first cavity, the second cavity, and the piston define a pressure chamber, and a first portion of the piston contacts the rotary output assembly, wherein the aperture is sized to allow a portion of the arcuate-shaped piston to pass through the aperture, and the piston seal provides sealing contact about the aperture between the seal carrier assembly and the arcuate-shaped piston.

2. The rotary actuator of claim 1, wherein the seal carrier assembly is configured for radial movement relative to the housing.

3. The rotary actuator of claim 1, wherein the piston seal is disposed about an interior surface of the aperture.

4. The rotary actuator of claim 1, wherein the housing is formed as a one-piece housing.

5. The rotary actuator of claim 1, wherein the piston has one of a square, rectangular, ovoid, elliptical, or circular shape in cross-section.

6. The rotary actuator of claim 1, wherein the piston is removably affixed to and extends from a rotor arm at a predetermined angle to the rotor arm.

7. The rotary actuator of claim 1, wherein the rotary actuator is configured to:

urge the piston partially outward from the pressure chamber to urge rotation of the rotary output assembly in a first direction, based on application of pressurized fluid to the pressure chamber;

rotate the rotary output assembly in a second direction opposite that of the first direction; and, urge the piston partially into the pressure chamber to urge pressurized fluid out of the pressure chamber.

8. The rotary actuator of claim 7, wherein the rotary actuator is further configured to urge, by the piston, movement of the seal carrier assembly relative to the housing.

9. The rotary actuator of claim 1, wherein the seal carrier assembly is configured to promote rotation of the rotary output assembly with constant torque over stroke when the piston is urged partially outward from the pressure chamber.

10. The rotary actuator of claim 1, wherein the piston seal has a circular or semi-circular sealing geometry.

11. The rotary actuator of claim 1, wherein the face seal has a circular or semi-circular sealing geometry.

12. The rotary actuator of claim 1, wherein the piston extends from the first piston portion affixed to the rotary output assembly to a second piston portion spaced apart from rotary output assembly, and a first radially outward surface portion of the first piston portion is configured for reciprocal motion along a first arc having a first radius from an axis, and a second radially outward surface portion of the second piston portion is capable of reciprocal and radial motion along a second arc having a variable second radius from the axis, and the rotary actuator further comprises a load bearing assembly comprising a radially inward surface facing the piston, spaced radially apart from the piston, configured for reciprocal movement along a third arc having a third radius from the axis that is radially larger than the first radius and is radially smaller than a portion of the variable second radius.

13. The rotary actuator of claim 12, wherein the load bearing assembly is affixed to the housing.

14. The rotary actuator of claim 12, wherein the piston is arranged to contact the load bearing assembly when the variable second radius exceeds the third radius.

15. The rotary actuator of claim 12, further comprising a spring member arranged to provide a bias force against the load bearing assembly and urging reciprocal movement of the load bearing assembly toward the open end.

16. The rotary actuator of claim 12, further comprising a rotor shaft, and the load bearing assembly further comprises a hinge at a proximal end configured for reciprocal movement upon the rotor shaft, wherein the rotary output assembly rotates concentrically about the rotor shaft and defines a radial aperture comprising a first radial face, and the load bearing assembly further comprises a body extending from the hinge through the radial aperture to a distal end comprising the radially inward surface, the body comprising a second radial face configured to contact the first radial face.

17. A method of rotary actuation comprising:

providing a rotary actuator comprising:

a housing defining an arcuate chamber portion and comprising a first cavity, a housing face portion having a first curvature, and an open end defined in the housing face portion;

a seal carrier assembly defining a second arcuate chamber portion and comprising a carrier face portion having a second curvature that matches the first curvature, an aperture defined through the carrier face portion, a face seal groove defined in the carrier face portion, a piston seal groove defined in the aperture, a pivot member rotatably affixed to the housing and configured to permit the seal carrier assembly to pivot about the pivot member relative to the housing such that the carrier face portion travels in an arc section having a third curvature that matches the second curvature, a second cavity in fluid communication with the first cavity, a piston seal arranged within the piston seal groove and a face seal arranged within the face seal groove in sealing contact between the carrier face portion and the housing face portion proximal to the open end and the aperture;

a rotary output assembly; and an arcuate-shaped piston disposed in said housing for reciprocal movement in the arcuate chamber portion and in the second arcuate chamber portion through the open end and the aperture, wherein the piston seal, the face seal, the first cavity, the second cavity, and the piston define a pressure chamber, and a first portion of the piston contacts the rotary output assembly, wherein the aperture is sized to allow a portion of the arcuate-shaped piston to pass through the aperture, and the piston seal provides sealing contact about the aperture between the seal carrier assembly and the arcuate-shaped piston;

applying pressurized fluid to the pressure chamber;

urging the piston partially outward from the pressure chamber to urge rotation of the rotary output assembly in a first direction;

rotating the rotary output assembly in a second direction opposite that of the first direction; and, urging the piston partially into the pressure chamber to urge pressurized fluid out of the pressure chamber.

18. The method of claim 17, further comprising urging, by the piston, radial movement of the seal carrier assembly relative to the housing.

19. The method of claim 17, wherein urging the piston partially outward from the pressure chamber to urge rotation of the rotary output assembly in a first direction further comprises rotating the output assembly in the first direction with substantially constant torque over stroke.

20. The method of claim 17, wherein the piston seal is disposed about an interior surface of the aperture.

21. The method of claim 17, wherein the piston is removably affixed to and extends from a rotor arm at a predetermined angle to the rotor arm.

* * * * *